US009718069B2

(12) United States Patent
Creaghan et al.

(10) Patent No.: US 9,718,069 B2
(45) Date of Patent: Aug. 1, 2017

(54) FOAM PUMP

(71) Applicant: PIBED LIMITED, Denby, Derbyshire (GB)

(72) Inventors: David Michael Ross Creaghan, Derby (GB); Robert Butler, Nottingham (GB); Dean Philip Limbert, Derby (GB); Christopher James Lang, Nottingham (GB); Stewart Banks, Near Carvoiro (PT)

(73) Assignee: DEB IP LIMITED, Denby, Derbyshire (GB)

( * ) Notice: Subject to any disclaimer, the term of this patent is extended or adjusted under 35 U.S.C. 154(b) by 72 days.

(21) Appl. No.: 14/710,345

(22) Filed: May 12, 2015

(65) Prior Publication Data

US 2015/0320266 A1 Nov. 12, 2015

Related U.S. Application Data

(60) Provisional application No. 61/992,101, filed on May 12, 2014.

(51) Int. Cl.
*B67D 7/76* (2010.01)
*B05B 7/00* (2006.01)
(Continued)

(52) U.S. Cl.
CPC ..... *B05B 7/0037* (2013.01); *A47K 5/1211* (2013.01); *B05B 11/3001* (2013.01); *A47K 5/14* (2013.01); *B05B 11/3087* (2013.01)

(58) Field of Classification Search
CPC ..... B05B 7/262; B05B 7/2443; B05B 7/0062; B05B 7/005; B05B 7/0018; B05B 7/0037;
(Continued)

(56) References Cited

U.S. PATENT DOCUMENTS 2,494,827 A 1/1950 Munter
3,422,993 A 1/1969 Boehm et al.
(Continued)

FOREIGN PATENT DOCUMENTS

CA 2233323 9/1996
CA 2276661 7/1998
(Continued)

OTHER PUBLICATIONS

International Search Report in PCT/CA2015/050471 dated Aug. 5, 2015.
(Continued)

*Primary Examiner* — J. Casimer Jacyna
*Assistant Examiner* — Benjamin R Shaw
(74) *Attorney, Agent, or Firm* — Dowell & Dowell, P.C.

(57) ABSTRACT

The present disclosure relates to a non-aerosol foam pump for use in association with an unpressurized liquid container and a foaming element comprising. The pump includes a liquid pump portion and an air pump portion. The liquid pump portion has a liquid chamber with a liquid internal volume and a shuttle liquid piston. The liquid chamber is in flow communication with the unpressurized liquid container and in flow communication with the foaming element. The air pump portion has an air chamber with an air internal volume. The air chamber is in flow communication with the foaming element. The liquid pump portion and the air pump portion have an activation stroke and a return stroke. During the activation stroke the air internal volume is reduced and during a beginning stage of the stroke the liquid internal volume remains the same and during a later stage the liquid internal volume is reduced.

17 Claims, 22 Drawing Sheets

(51) Int. Cl.
*A47K 5/12* (2006.01)
*B05B 11/00* (2006.01)
*A47K 5/14* (2006.01)

(58) Field of Classification Search
CPC ..... B05B 11/3001; B05B 11/3087; B05B 11/3084; A47K 5/1211; A47K 5/14
USPC ..... 222/190, 137, 136, 135, 129; 239/398
See application file for complete search history.

(56) References Cited

U.S. PATENT DOCUMENTS 3,709,437 A 1/1973 Wright
3,743,146 A 7/1973 Schindler
3,985,271 A 10/1976 Gardner
4,019,657 A 4/1977 Spitzer et al.
4,022,351 A 5/1977 Wright
4,051,877 A 10/1977 Fletcher et al.
4,155,870 A 5/1979 Jorgensen
4,238,056 A 12/1980 Tucker et al.
4,615,467 A 10/1986 Grogan et al.
4,621,749 A 11/1986 Kanfer
4,639,367 A 1/1987 Mackles
4,880,161 A * 11/1989 Wright ..... B05B 11/3087 222/190
4,978,036 A 12/1990 Burd
5,048,750 A 9/1991 Tobler
5,156,307 A 10/1992 Callahan et al.
5,165,577 A 11/1992 Ophardt
5,169,029 A * 12/1992 Behar ..... B05B 11/3084 128/200.23
5,174,476 A 12/1992 Steiner et al.
5,232,632 A 8/1993 Woo et al.
5,238,155 A 8/1993 Blake, III
5,248,066 A 9/1993 Olson et al.
5,279,755 A 1/1994 Choy et al.
5,289,952 A 3/1994 Gueret
5,372,281 A 12/1994 Palmer et al.
5,425,404 A 6/1995 Dyer
5,445,288 A * 8/1995 Banks ..... B05B 7/0025 222/105
6,082,586 A 7/2000 Banks
6,271,275 B1 8/2001 Malwitz
6,276,613 B1 * 8/2001 Kramer ..... A47L 11/34 134/102.2
6,321,943 B1 11/2001 Strickler et al.
6,394,316 B1 5/2002 Daansen
6,699,019 B2 3/2004 Myers et al.
6,821,942 B2 11/2004 Sebillotte-Arnaud et al.
6,913,251 B2 7/2005 Kerfoot
8,002,151 B2 8/2011 Matthews et al.
8,281,958 B2 10/2012 Matthews et al.
8,544,698 B2 * 10/2013 Ciavarella ..... A47K 5/14 222/145.5
8,591,207 B2 11/2013 Ciavarella
8,991,657 B2 3/2015 Ciavarella et al.
2004/0234458 A1 11/2004 Riedel et al.
2005/0224519 A1 10/2005 Law et al.
2005/0258192 A1 * 11/2005 Matthews ..... A47K 5/14 222/190
2007/0278247 A1 * 12/2007 Banks ..... B05B 7/2497 222/132
2009/0184134 A1 * 7/2009 Ciavarella ..... A47K 5/14 222/135
2009/0184136 A1 * 7/2009 Ciavarella ..... A47K 5/1208 222/190
2011/0155767 A1 6/2011 Ray
2013/0037573 A1 * 2/2013 Spiegelberg ..... A47K 5/14 222/190
2013/0119083 A1 * 5/2013 Ophardt ..... A47K 5/1204 222/64
2013/0200098 A1 * 8/2013 Li ..... A47K 5/16 222/52
2014/0054323 A1 * 2/2014 McNulty ..... A47K 5/14 222/190
2014/0203047 A1 * 7/2014 McNulty ..... B05B 7/0025 222/190

FOREIGN PATENT DOCUMENTS

CA 2244591 8/1998
CA 2333455 12/1999
CA 2202224 1/2001
CA 2447786 11/2002
CA 2465615 5/2003
CA 2461430 9/2005
CA 2669519 12/2009
DE 4429454 2/1996
EP 0056713 7/1982
EP 0392238 1/1995
EP 0670712 8/1996
EP 0765932 4/1997
EP 0618147 5/1997
EP 0829259 3/1998
FR 2698102 5/1994
GB 2193904 2/1988
GB 2335005 9/1999
WO 9813144 4/1998
WO 9922698 5/1999
WO 9922701 5/1999
WO 0061076 10/2000
WO 0130310 5/2001
WO 02092025 11/2002

OTHER PUBLICATIONS

Written Opinion in PCT/CA2015/050471 dated Aug. 5, 2015.
International Search Report in PCT Application No. PCT/CA2005/000690, dated Sep. 22, 2005.
Supplementary European Search Report in EP Application No. 05741084.7-2108, dated May 10, 2011.

* cited by examiner

FOAM PUMP

FIELD OF THE DISCLOSURE

This disclosure relates to foam pumps and in particular foam pumps pressurize the air before pressurizing the liquid.

BACKGROUND

Recently, a new type of pump capable of dispensing hand cleansers with mechanical scrubber in a foam format through a non-aerosol dispensing system has been developed (U.S. Pat. Nos. 8,002,151 and 8,281,958). This pump is an integral part of a platform that has allowed for the creation of a new hand cleanser category. This category is foam soap with mechanical, scrubbers.

Prior to the development of a pump that was capable of creating foam with mechanical scrubbers, existing foam pumps such as those described in U.S. Pat. Nos. 5,445,288 & 6,082,586 had the limitation of dispensing foam only. The reason for this is that standard foaming technologies create the foam by passing liquid and air through a porous media to generate the foam. If this technique was employed to create foam with mechanical scrubbers, the pump would simply 'sieve' the scrubbers from the liquid and cease to operate. A key characteristic of the hand cleansers dispensed from this type of pump is low viscosity. The viscosity of this form of hand cleanser is generally less than 100 cPoise and is tailored to be easily mixed with air through a porous media to produce foam from a pump.

The hand cleanser characteristics required to create foam with mechanical scrubbers are very different. If the hand cleanser is too thin (viscosity too low) and has a Newtonian rheological behaviour, the mechanical scrubbers will fall out of suspension. If the product is too thick (too viscous), the amount of force required to foam the formulation becomes too high resulting in excessive operating force for the dispenser user and a poor quality foam results. The viscosity range of this type of hand cleanser is generally between 500 cPoise and 4000 cPoise.

Typical non-aerosol foam pumps operate by pumping both air and liquid simultaneously. In essence the foam pump is a combination two pumps (an air pump and a liquid pump) working in tandem to bring a predetermined volume of air together with a predetermined volume of liquid. Since air is generally introduced into the liquid, the viscosity of the liquid will impact on the ability of the air to efficiently infuse. The resistance to infusion translates into back pressure being generated within the pump.

The efficiency of the infusion process is also limited by the simultaneous action of pumping the air into the liquid. Air is a compressible medium whist the liquid is not. Therefore when the air and liquid are being pumped the air compresses due to the resistance applied to it as it is being forced to infuse into the liquid. The result of this is variable foam quality where the ratio of air to liquid is lower at the start of the pumping process and higher at the end of the pumping process. For the pump user, this means the foam generated at the start of the pumping process is wetter than it is at the end. This condition is even more pronounced if a bellows pump or a diaphragm pump is used. These types of pumps deform as they collapse and during the deformation phase, little to no air is being delivered to a mixing chamber and thus the resultant foam is watery at the beginning part of the stroke. This problem is largely overcome with piston pumps for both the air and liquid. However, with a foaming element that includes a sparging element it would be advantageous to build up air pressure on the air side of and within the sparging element before liquid is delivered to the foaming element. Another issue that arises when attempting to foam higher viscosity foam soaps with mechanical scrubbers (as described above) using a foaming element that includes a sparging element is the ability to provide sufficient dwell time to maximize the air infusion process to create a high quality foam.

SUMMARY

The present disclosure relates to a non-aerosol foam pump for use in association with an unpressurized liquid container and a foaming element comprising. The pump includes a liquid pump portion and an air pump portion. The liquid pump portion has a liquid chamber with a liquid internal volume and a shuttle liquid piston. The liquid chamber is in flow communication with the unpressurized liquid container and in flow communication with the foaming element. The air pump portion has an air chamber with an air internal volume. The air chamber is in flow communication with the foaming element. The liquid pump portion and the air pump portion have an activation stroke and a return stroke and during the activation stroke the air internal volume is reduced and during a beginning stage of the activation stroke the liquid internal volume of the liquid chamber remains the same and during a later stage of the activation stroke the liquid internal volume of the liquid chamber is reduced.

The shuttle liquid piston may include a shuttle portion and a main portion and the shuttle portion slidingly engages the main portion, the shuttle portion slides relative to the main portion in the beginning stage of the activation stroke and engages the main portion in the later stage of the activation stroke thereby reducing the liquid internal volume of the liquid chamber in the later stage of the activation stroke.

The foaming element may include a sparging element, a foaming element air chamber in flow communication with the air chamber and a foaming chamber in flow communication with the liquid chamber and wherein air is pushed from the foaming element air chamber through the sparging element into the foaming chamber.

The foaming element may be a first foaming element and further including a second foaming element and wherein liquid from the liquid chamber is in flow communication with the first and second foaming element and air from the air chamber is in flow communication with the first and second foaming element and wherein the first and second foaming elements each have exit channels that may merge into a merged flow channel and into an exit nozzle.

The non-aerosol foam pump may include an activator and the shuttle liquid piston includes a shuttle portion and a main portion and activator slides along the shuttle portion at the beginning stage of the activation stroke and in the later stage of the activation stroke the activator engages the main portion whereby in the later stage of the activation stroke the liquid internal volume of the liquid chamber is reduced.

The non-aerosol foam pump may include a dispenser for housing the pump and liquid container.

The air pump portion may include an air piston.

The non-aerosol foam pump may further include an activator connected to the air piston and the shuttle portion of the shuttle liquid piston, whereby the air piston is operably connected to the shuttle liquid piston through the activator.

The shuttle portion of the shuttle liquid piston may be slidingly attached to the activator and the air piston may be rigidly attached to the activator.

The air piston may be operably connected to the liquid piston, such that the shuttling liquid piston is actuated upon actuating the air piston.

The liquid chamber may be co-axial with the air chamber.

The air piston may include a liquid piston portion that slidingly engages the shuttle liquid piston.

The non-aerosol foam pump may include a liquid outlet valve between the liquid chamber and the foaming element.

The shuttle liquid piston may extend coaxially within the air pump portion, and the air piston may be attached to the shuttle portion of the shuttle liquid piston.

The non-aerosol foam pump may include a liquid outlet valve between the liquid piston and the foaming element.

The foaming element may comprise a mixing chamber and a foaming portion, whereby a mixture of the air and liquid is pushed from the mixing chamber through the foaming portion.

The foaming element may include a foaming portion and the foaming portion is a porous member.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
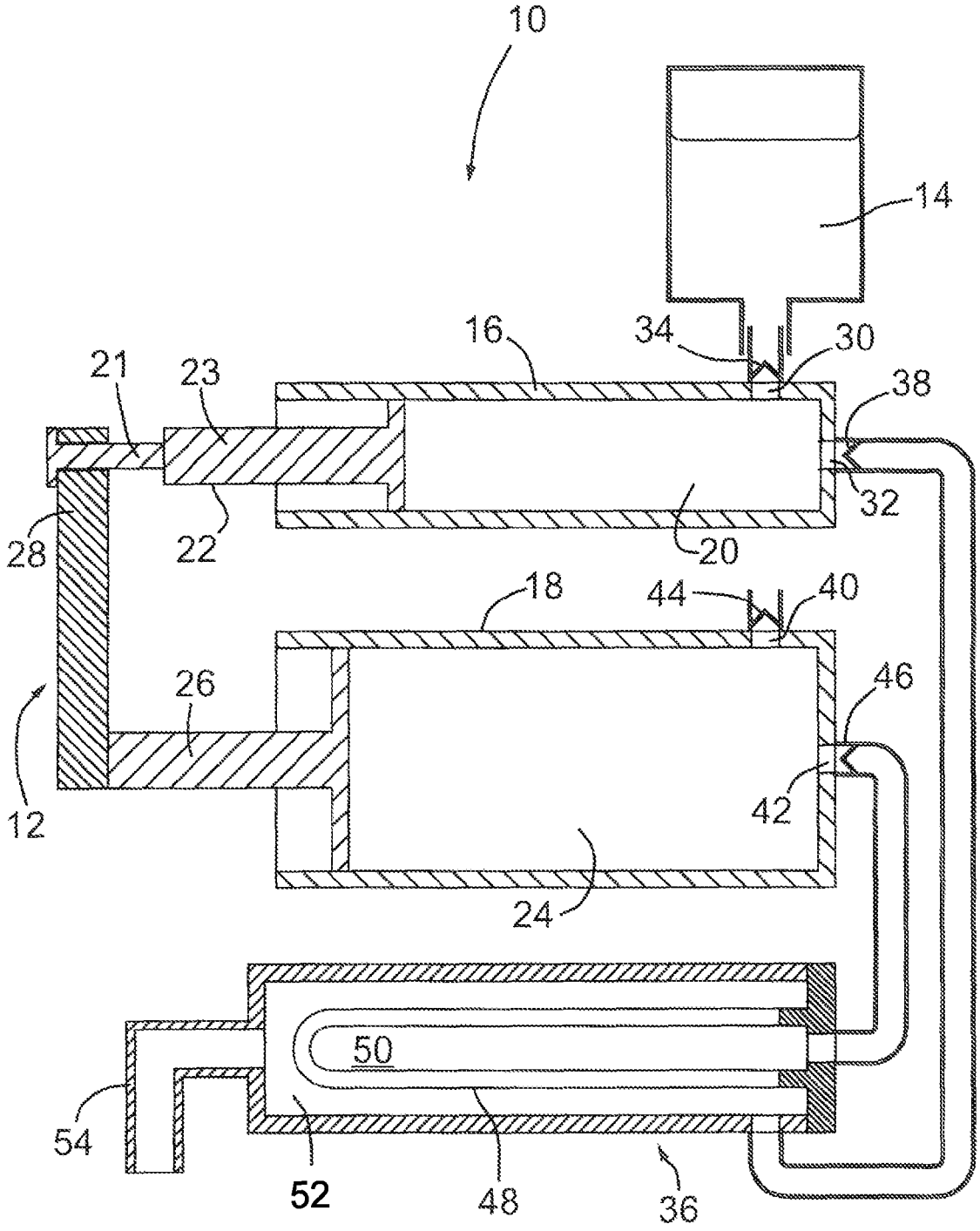
FIG. 1 is a cross sectional schematic representation of a dispenser with an improved foam pump at the beginning of the stroke.

Referring to FIGS. 1 to 6, schematic views of a dispenser are shown generally at 10. Dispenser 10 includes an improved foam pump 12. The pump 12 is a non-aerosol pump for use with an unpressurized liquid container 14.

The pump 12 includes a liquid pump portion 16 and an air pump portion 18. The liquid pump portion 16 includes a liquid chamber 20 and a liquid piston 22. The liquid piston 22 is a shuttling liquid piston. The air pump portion 18 includes an air chamber 24 and an air piston 26. The shuttling liquid piston 22 and the air piston 26 are both operably connected to an activator 28. The shuttling liquid piston 22 includes a shuttle portion 21 and a main portion 23. The shuttle portion 21 of the liquid piston 22 is slidingly attached to the activator 28 and the air piston 26 is rigidly attached to the activator 28.

The liquid chamber 20 has a liquid inlet 30 and a liquid outlet 32. The liquid chamber 20 is operably connected to the unpressurized liquid container 14. A liquid inlet valve 34 is positioned between the liquid chamber 20 and the liquid container 14. The liquid chamber 20 is in flow communication with a foaming element 36. A liquid outlet valve 38 is positioned between the liquid chamber 20 and the foaming element 36.

The air chamber 24 has an air inlet 40 and an air outlet 42. An air inlet valve 44 is positioned between the air chamber 24 and the outside air. The air chamber 24 is in flow communication with the foaming element 36. An air outlet valve 46 is positioned between the air chamber 24 and the foaming element 36.

The foaming element 36 includes a sparging element 48 a foaming element air chamber 50 on one side thereof and a foaming chamber 52 on the other side thereof. The foaming element air chamber 50 is in flow communication with the air chamber 24 of the air pump portion 18. The foaming chamber 52 is in flow communication with the liquid chamber 20 of the liquid pump portion 16. Air is pushed under pressure through the sparging element 48 into the liquid in the foaming chamber 52 to create foam. The foam exits the foaming element 36 at the exit nozzle 54.

Figure 2:
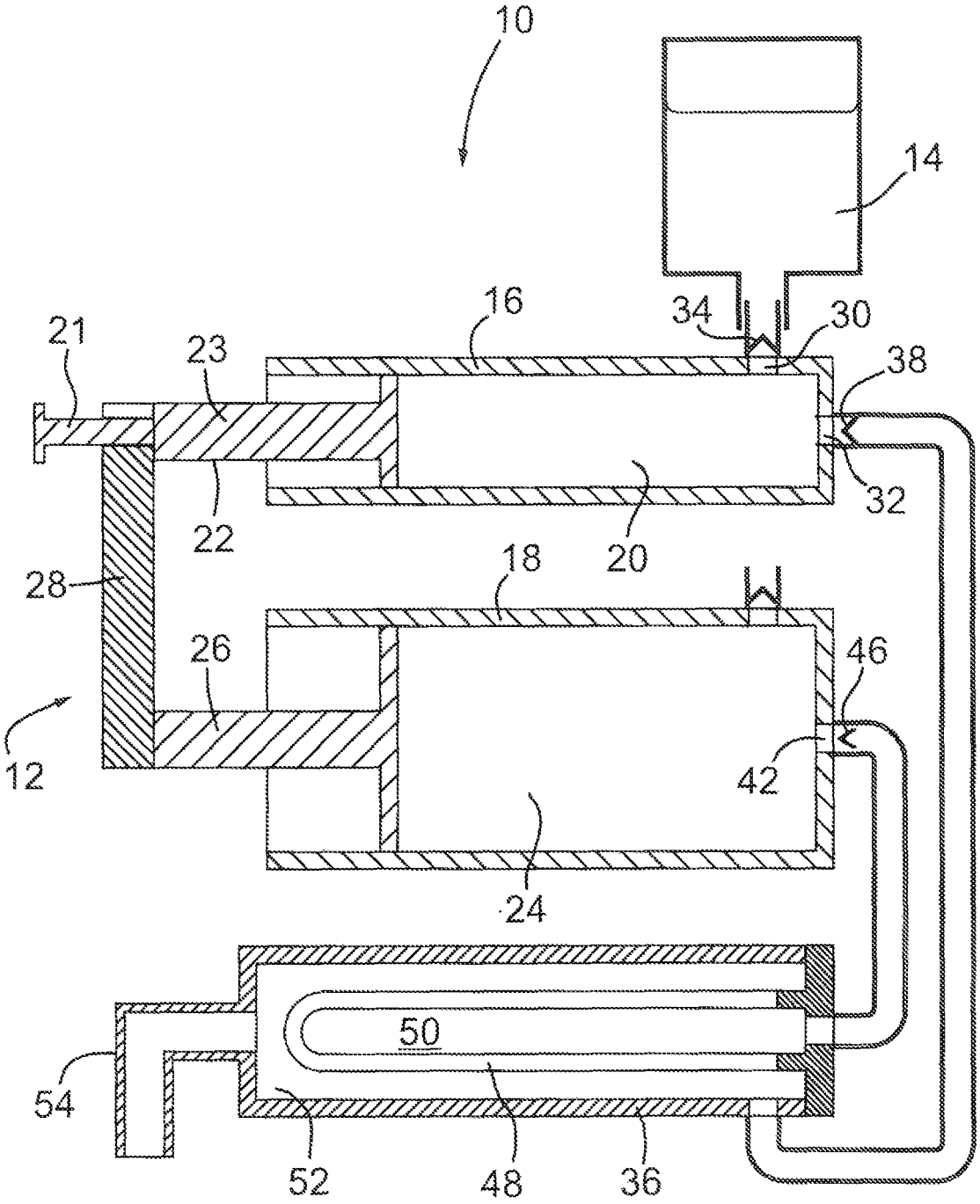
FIG. 2 is a cross sectional schematic representation of the dispenser with the improved foam pump of FIG. 1 but showing at an intermediate stage of the stroke.
Figure 3:
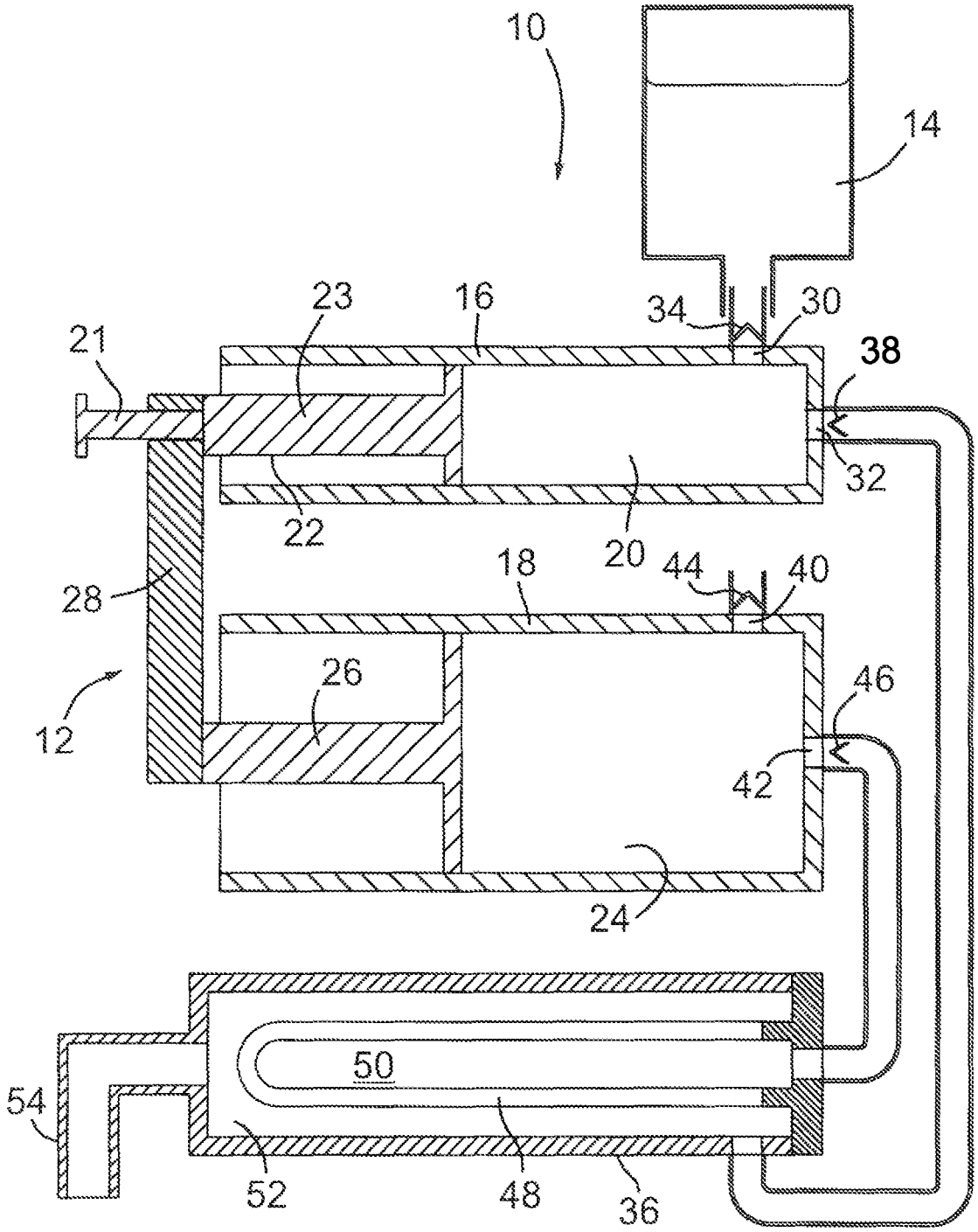
FIG. 3 is a cross sectional schematic representation of the dispenser with the improved foam pump of FIGS. 1 and 2 but showing it at the end of the stroke.
Figure 4:
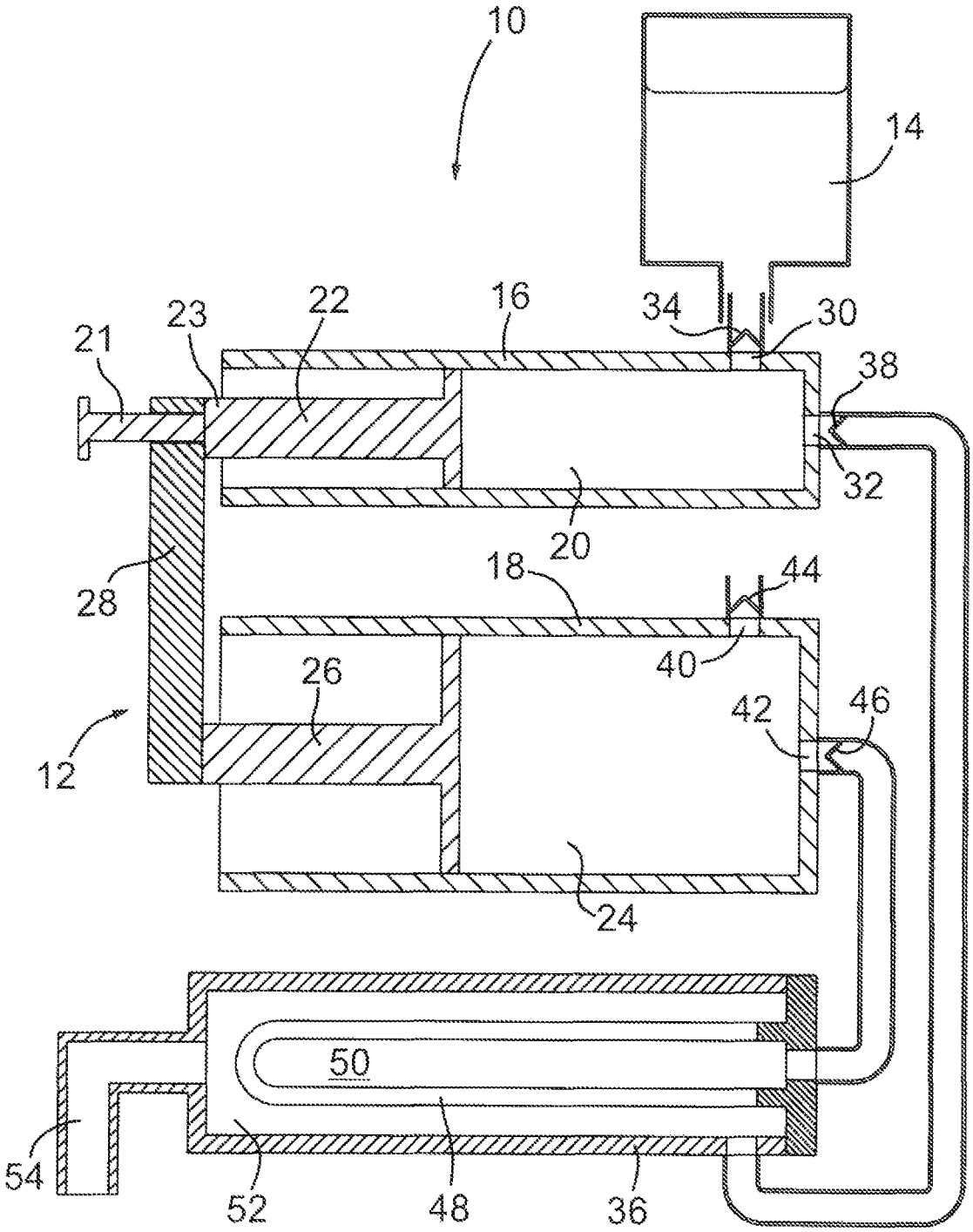
FIG. 4 is a cross sectional schematic representation of the dispenser with the improved foam pump of FIGS. 1 to 3 but showing it at the end of the stroke at the transition to the return stroke.
Figure 5:
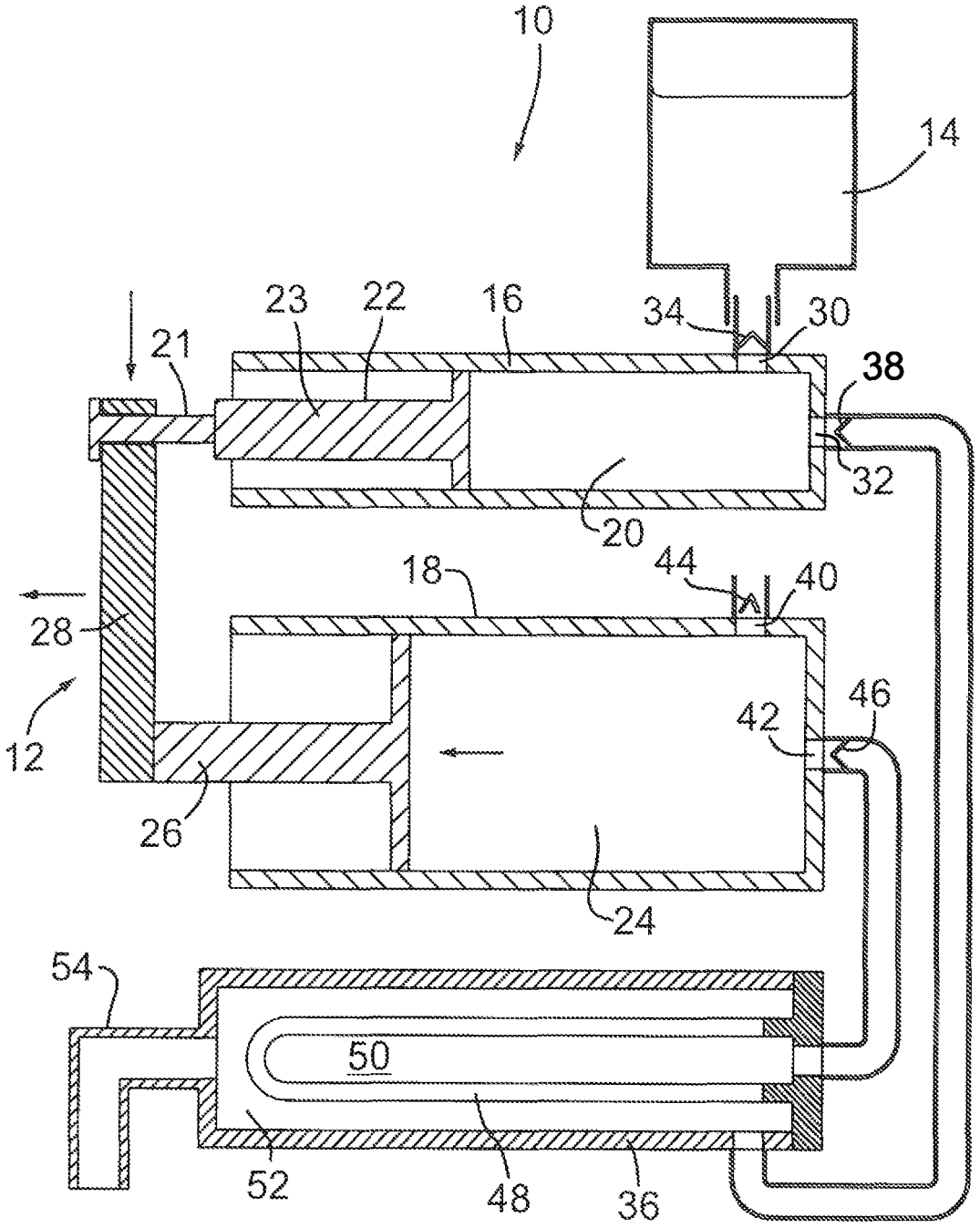
FIG. 5 is a cross sectional schematic representation of the dispenser with the improved foam pump of FIGS. 1 to 4 but showing an in intermediate stage of the return stroke.
Figure 6:
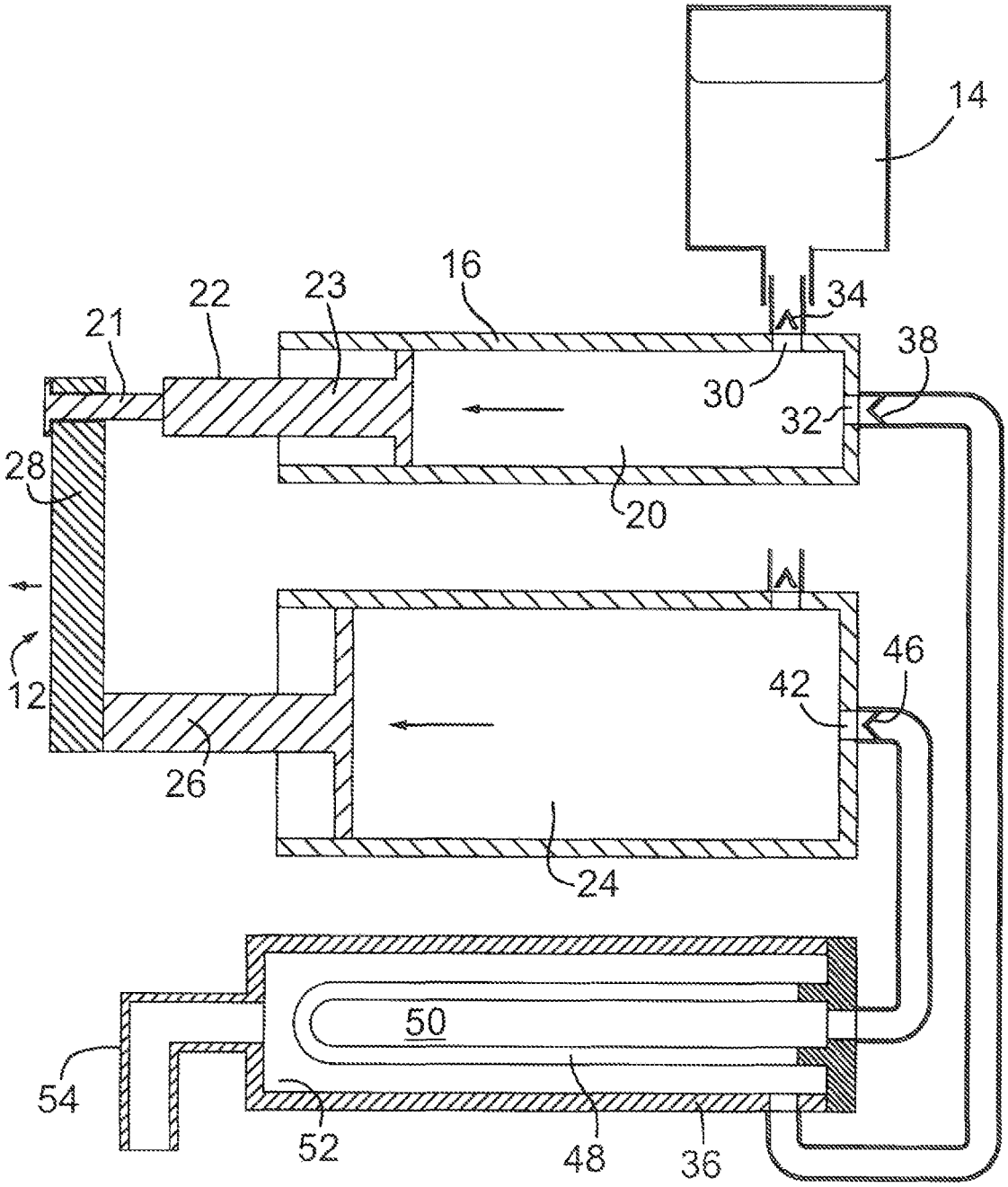
FIG. 6 is a cross sectional schematic representation of the dispenser with the improved foam pump of FIGS. 1 to 5 but showing it at the end of the return stroke.
Figure 7:
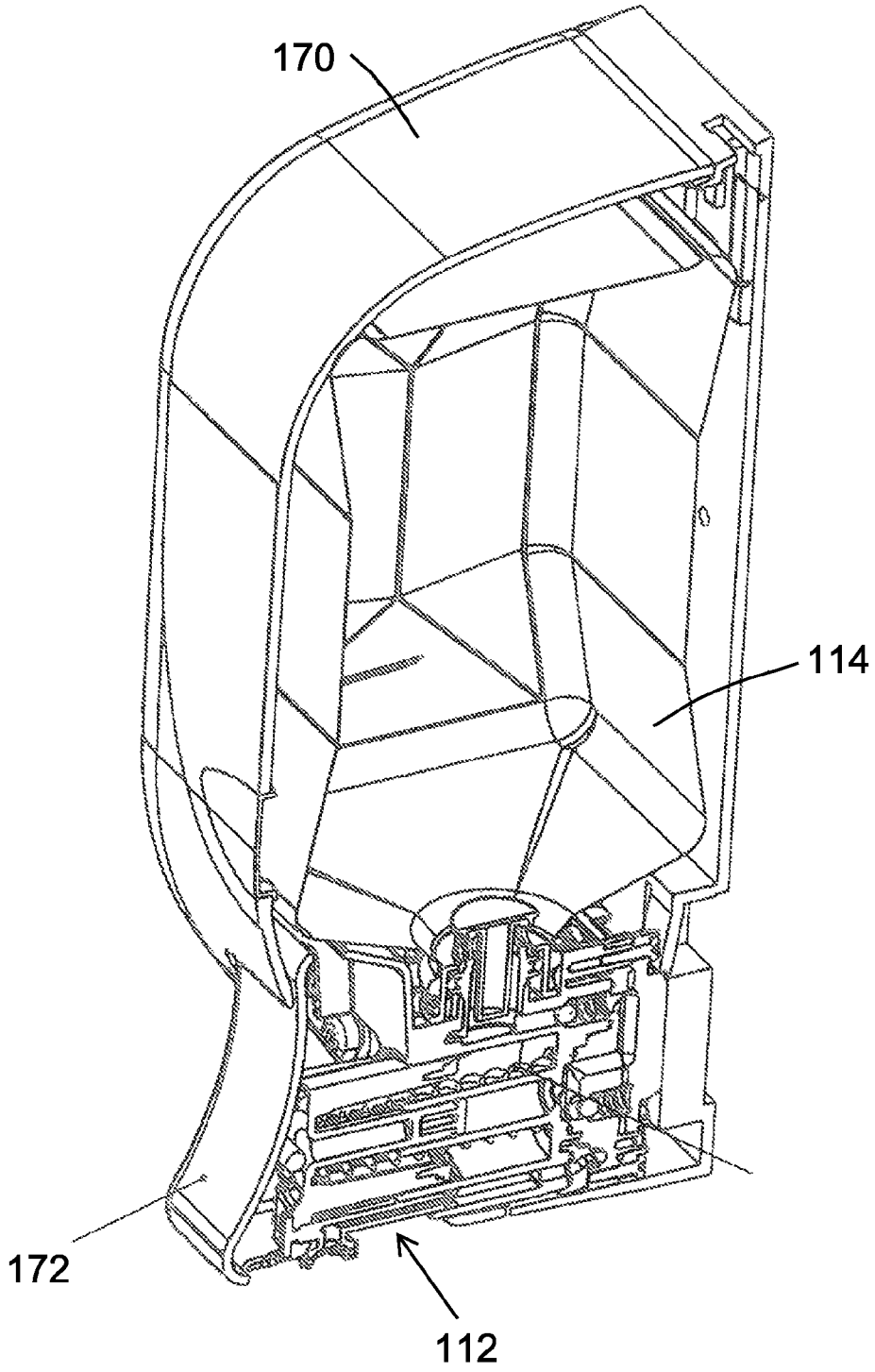
FIG. 7 is a cross sectional view of an improved pump.
Figure 8:
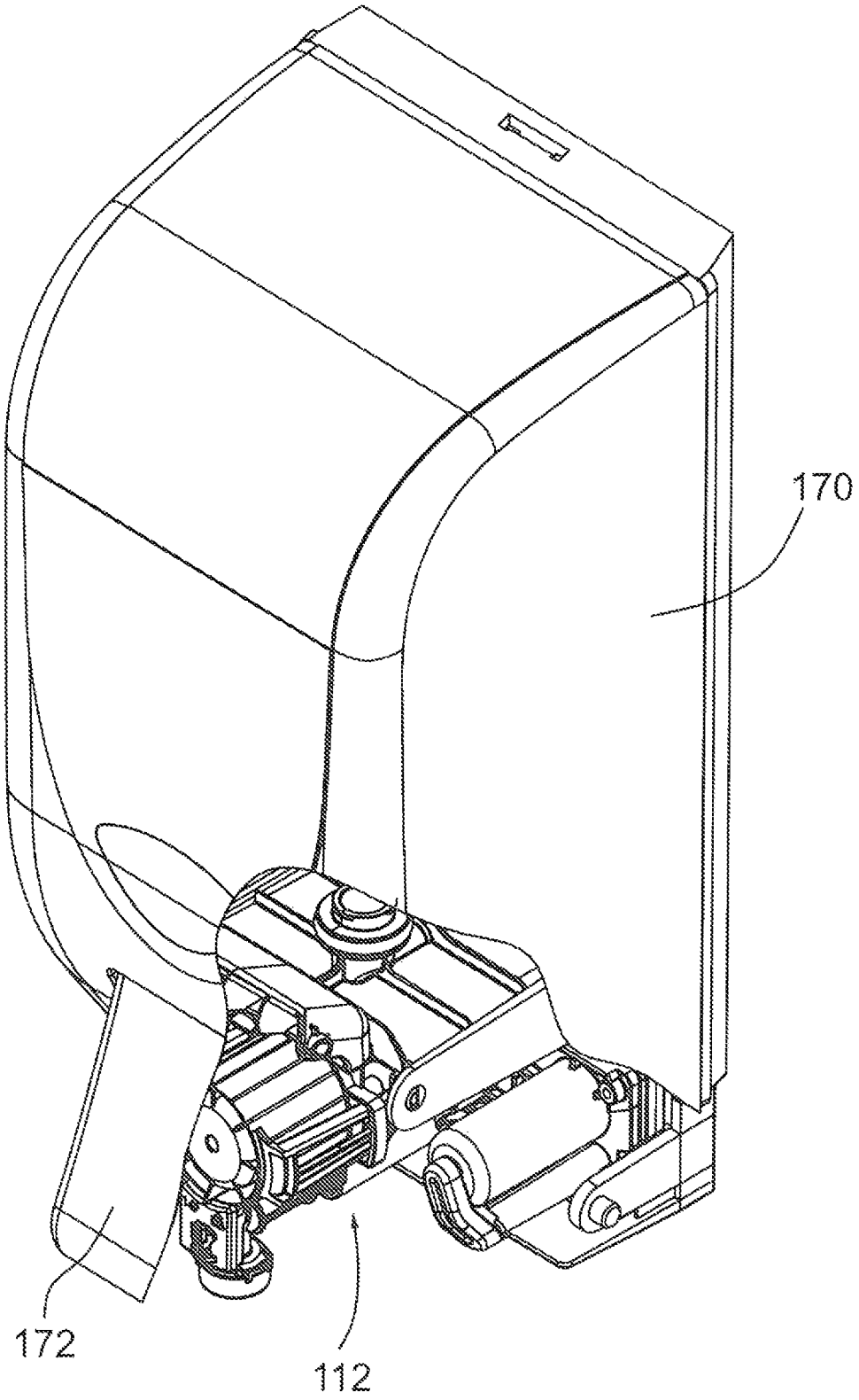
FIG. 8 is a perspective view of the dispenser of shown in FIG. 7 and showing an alternate embodiment of an improved pump.
Figure 9:
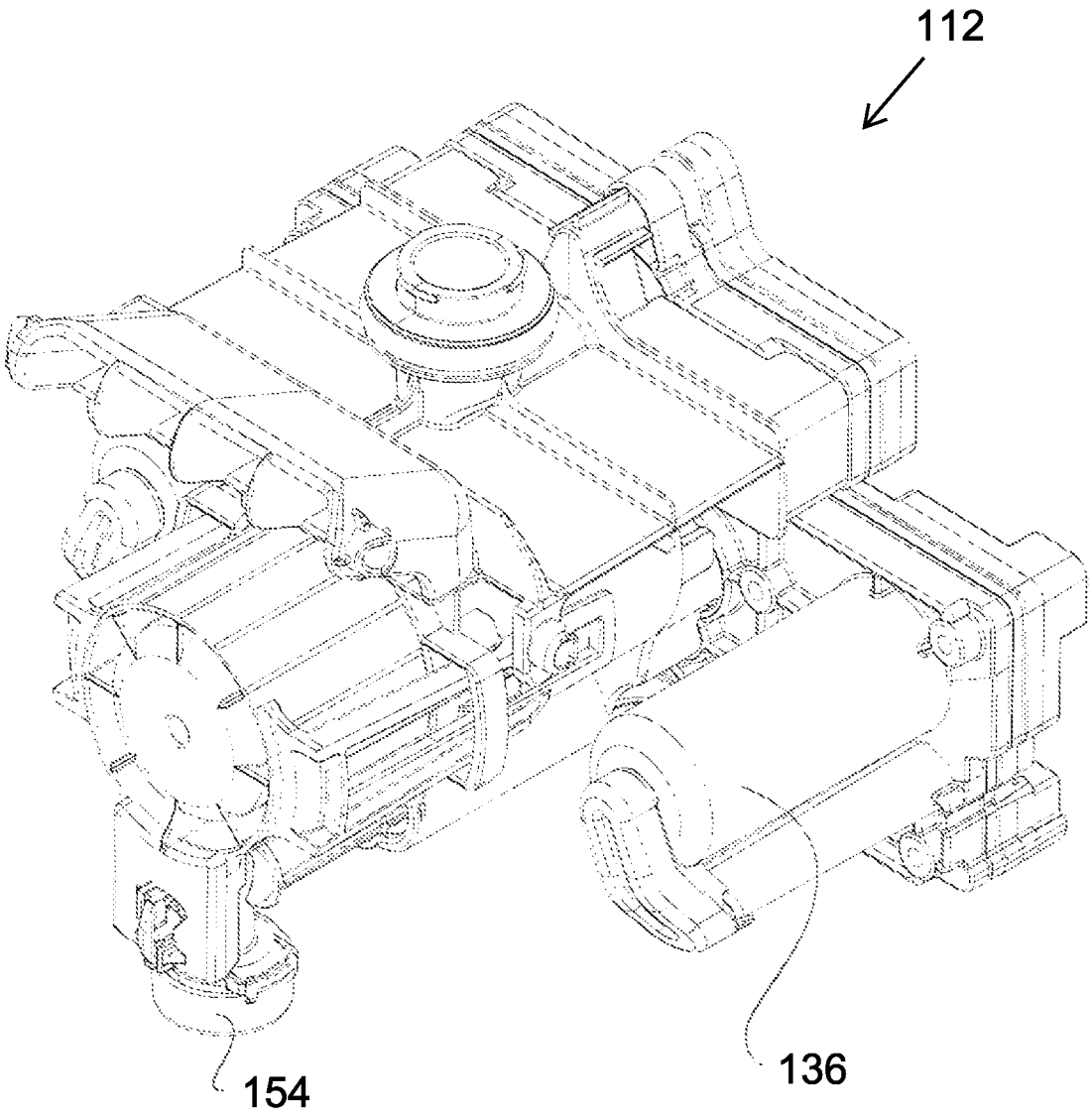
FIG. 9 is a perspective view of the improved pump of FIG. 8
Figure 10:
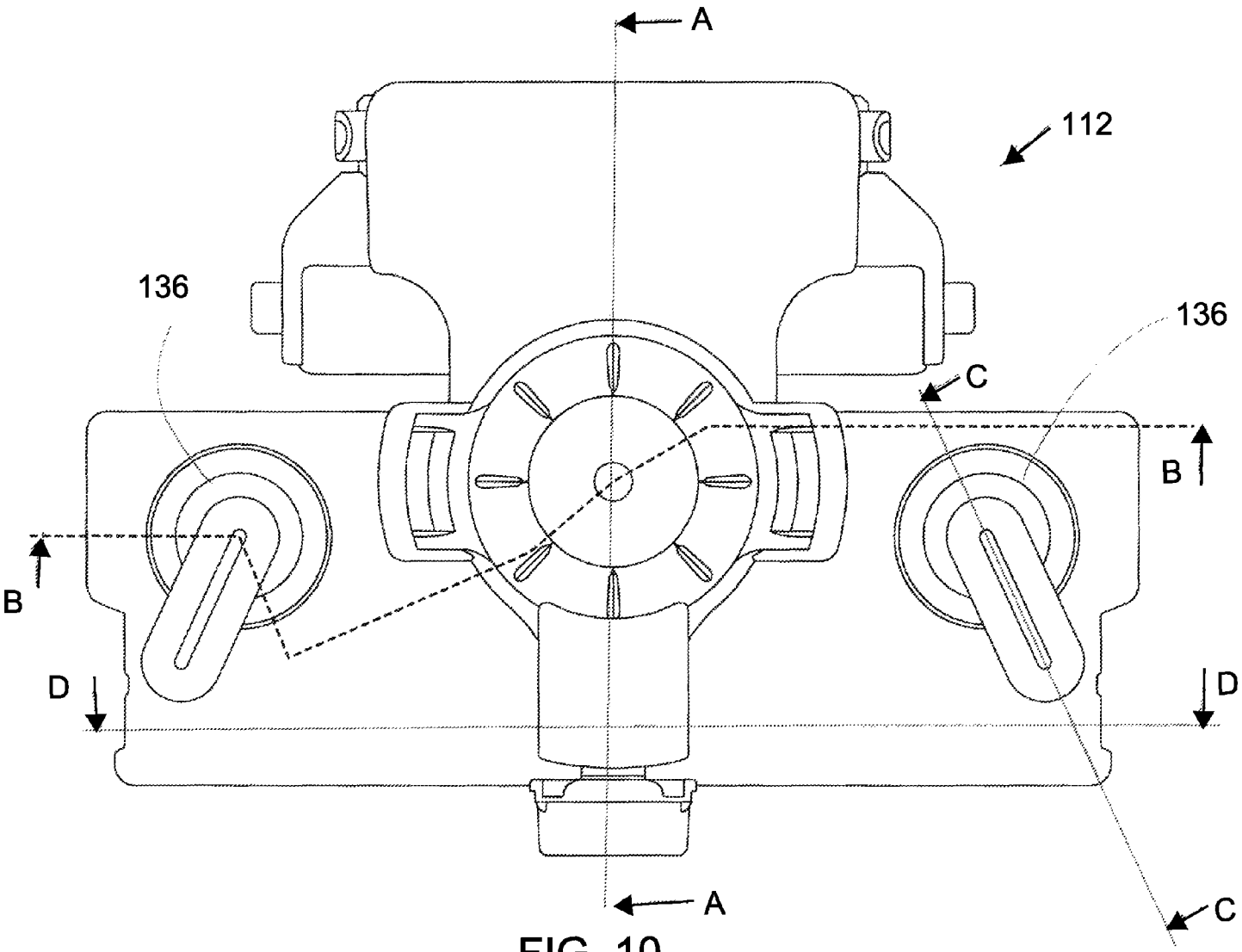
FIG. 10 is a front view of the improved pump of FIG. 9
Figure 11:
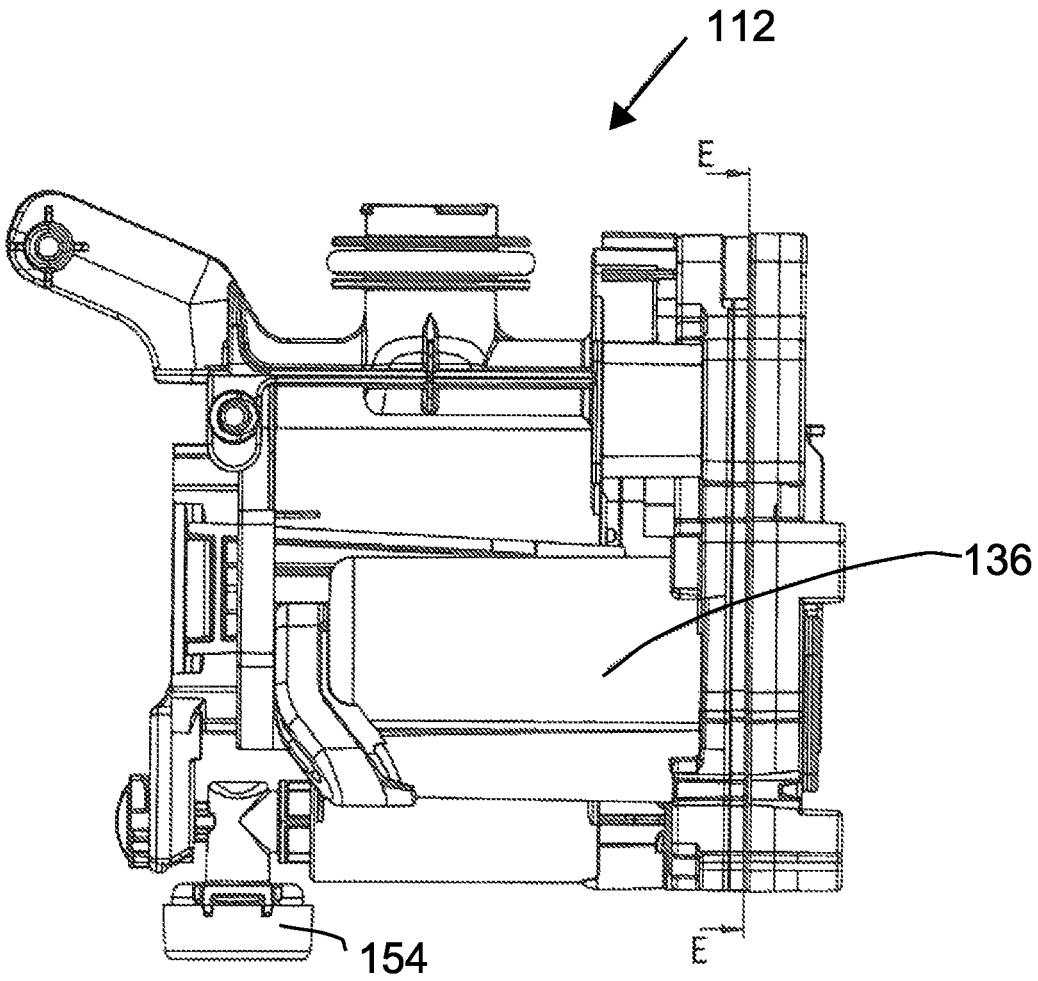
FIG. 11 is side view of the improved pump of FIG. 9.

FIGS. 1 to 6 show the stages of the pump as it moves through a stroke. FIG. 1 shows the pump 12 at rest. As the stroke begins to move, as shown in FIG. 2, air is compressed in the air chamber 24 of air pump and the air outlet valve 46 opens and air enters foaming element air chamber 50. Air is pushed through the sparging element 48 and meets resistance from the liquid in the foaming chamber 52 and to a lesser degree from the sparging element 48 itself. Air pressure builds to a sufficient level to allow it to be infused into liquid in the foaming chamber 52. In the initial stages of the stroke the activator moves along the shuttle portion of the liquid piston 22 and thus the liquid piston 22 does not move. This is the "priming" stage where the air chamber is "primed" before the liquid pump is engaged. Once the activator 28 hits the main portion 23 of the liquid piston 22 the liquid piston 22 moves together with the air piston 26 and pressure builds in the liquid chamber 20 and the liquid outlet valve 38 opens and liquid flows into the foaming chamber 52 where it is infused with air to form foam. At the end of the stroke, shown in FIG. 4, the direction of the activator 28 changes. This is typically when the user stops pushing the activator inwardly. At the end of the stroke, the liquid inlet valve 34 is closed; the liquid outlet valve 38 is closed; the air inlet valve 44 is closed and the air outlet valve 46 is closed. In the initial stage of the return stroke shown in FIG. 5, only the air piston 26 moves and the activator 28 moves along the shuttle portion 21 of the liquid piston 22 and the main portion of the liquid piston 23 does not move within the liquid chamber 20. As the activator 28 continues along the return stroke, the air inlet valve 44 opens and air moves into the air chamber 24 and the activator 28 moves along the shuttle portion 21 of the liquid piston 22 as shown in FIG. 5. As the activator continues to move along the return stroke, the liquid inlet valve 34 opens and liquid moves into the liquid chamber 20 as shown in FIG. 6.

The end of the stroke or rest position of the pump 12 is shown in FIG. 1 wherein the liquid inlet valve 34, liquid outlet valve 38, air inlet valve 44 and air outlet valve 46 are all closed.

It should be noted that in the schematic diagrams of FIGS. 1-6, the pump would be biased in the at rest position with a biasing means which is not shown but is well known in the art.

Referring to FIGS. 7 to 20 an alternate embodiment of an improved foam pump is shown at 112. The pump 112 is a non-aerosol pump for use with an unpressurized liquid container 114. FIGS. 10 through 20 have been simplified where possible such that pieces that are fixed together may be shown as one piece.

The pump 112 includes a liquid piston pump portion 116 and an air pump portion 118. The liquid piston pump portion 116 includes a liquid chamber 120 and a liquid piston 122. The liquid piston 122 is a shuttling liquid piston. The air pump portion 118 includes an air chamber 124 and an air piston 126. The air chamber 124 surrounds the liquid chamber 120 and is co-axial with the liquid chamber 120. The shuttling liquid piston 122 and the air piston 126 are operably connected such that by actuating the air piston 126 the shuttling liquid piston in turn may be actuated. The air piston 126 includes a liquid piston portion 121 that slidingly engages the shuttling liquid piston 122. In the beginning part of the stroke the shuttling liquid piston 122 does not move relative to the air piston 126 and the volume of the liquid chamber 120 remains unchanged while the volume of the air chamber 124 begins to be reduced. This is the "priming" stage where the air chamber is "primed" before the liquid pump is engaged. At the transition point the liquid piston portion 121 of the air piston 126 engages the shuttling liquid piston 122 and thereafter the volume of both the air chamber 124 and the liquid chamber 120 are reduced.

Figure 14:
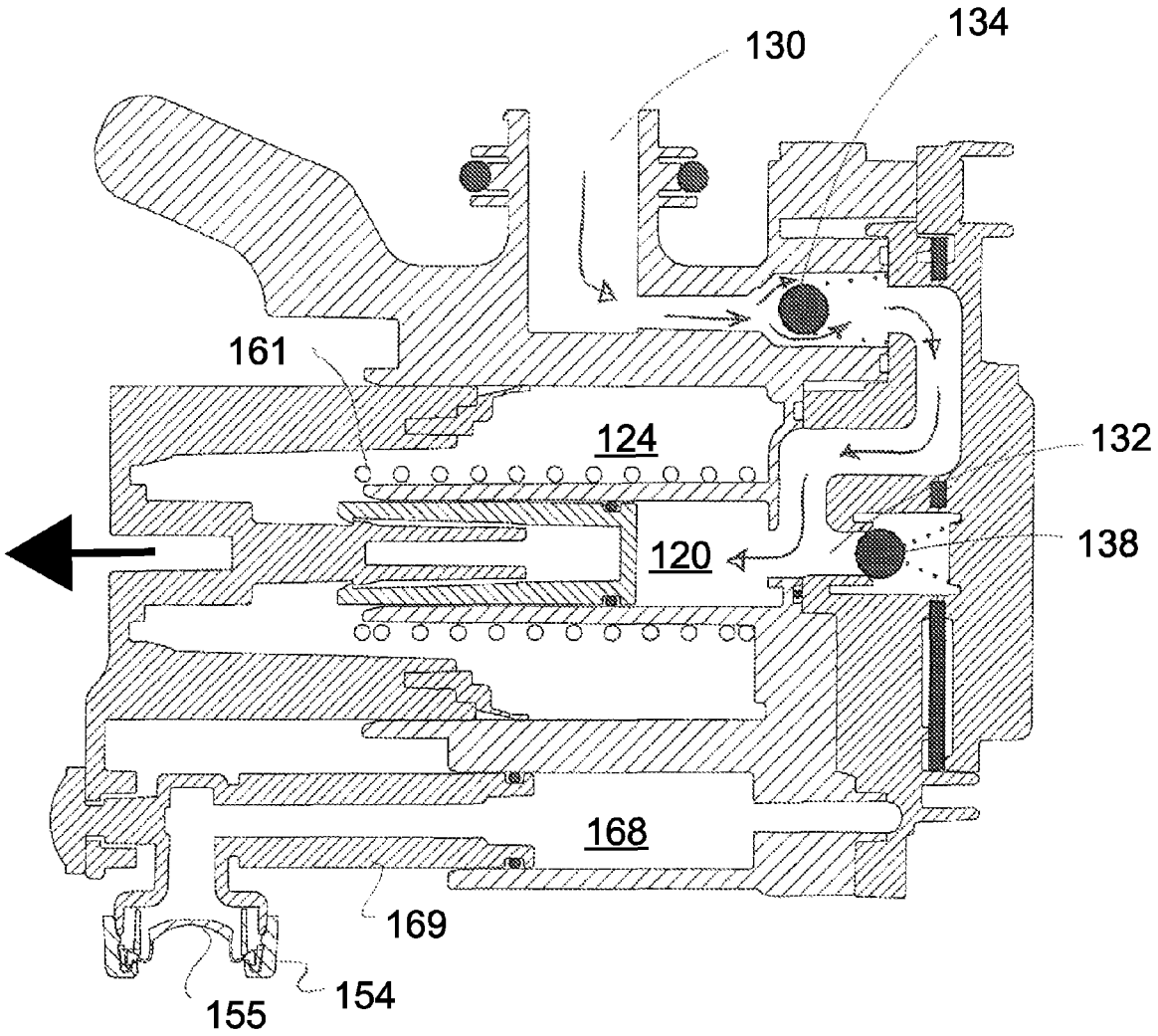
FIG. 14 is a cross sectional view of the improved pump along line A-A of FIG. 10, showing the liquid inlet path.
Figure 15:
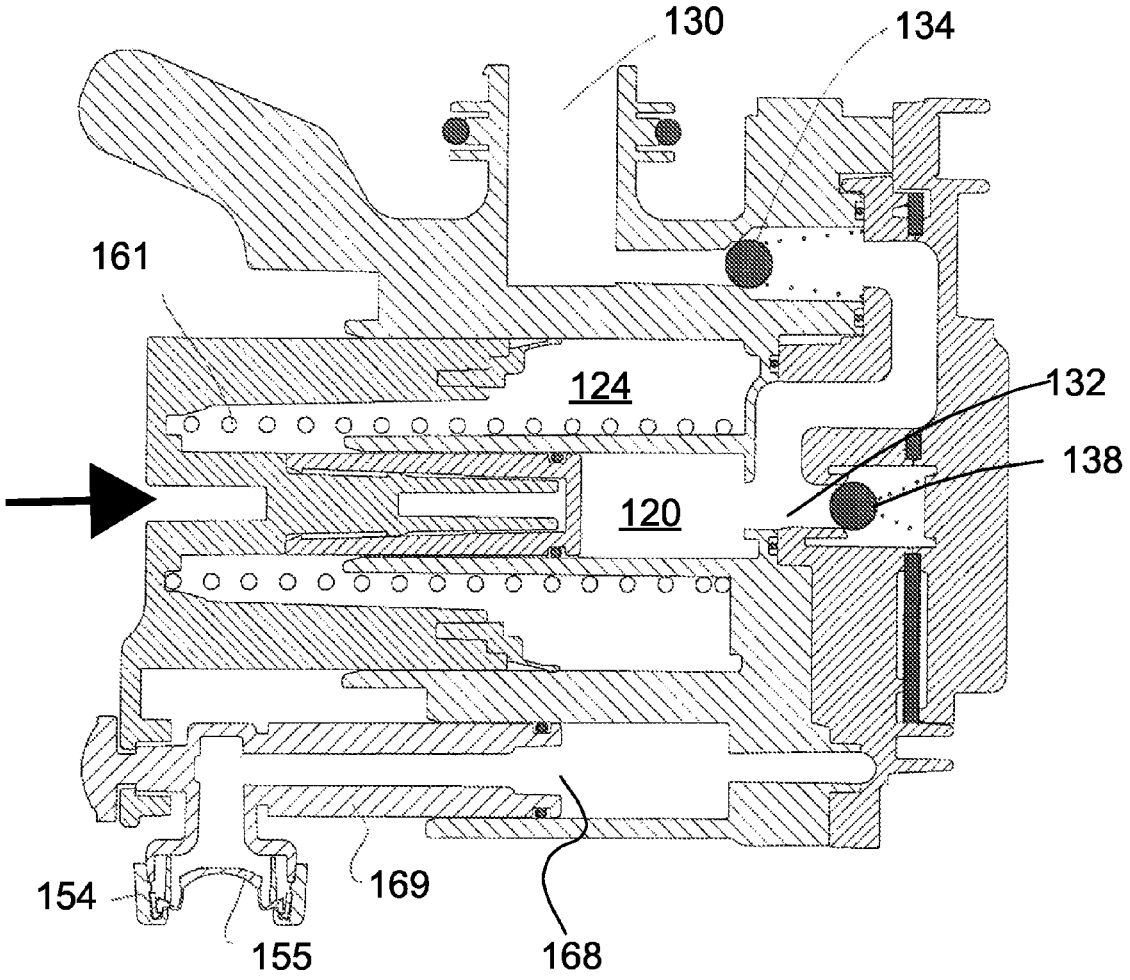
FIG. 15 is a cross sectional view of the improved pump along line A-A of FIG. 10, shown at an intermediate first stage of the stroke at the transition between where only the volume of the air chamber is effected to where both the air chamber and the liquid chamber is effected.
Figure 16:
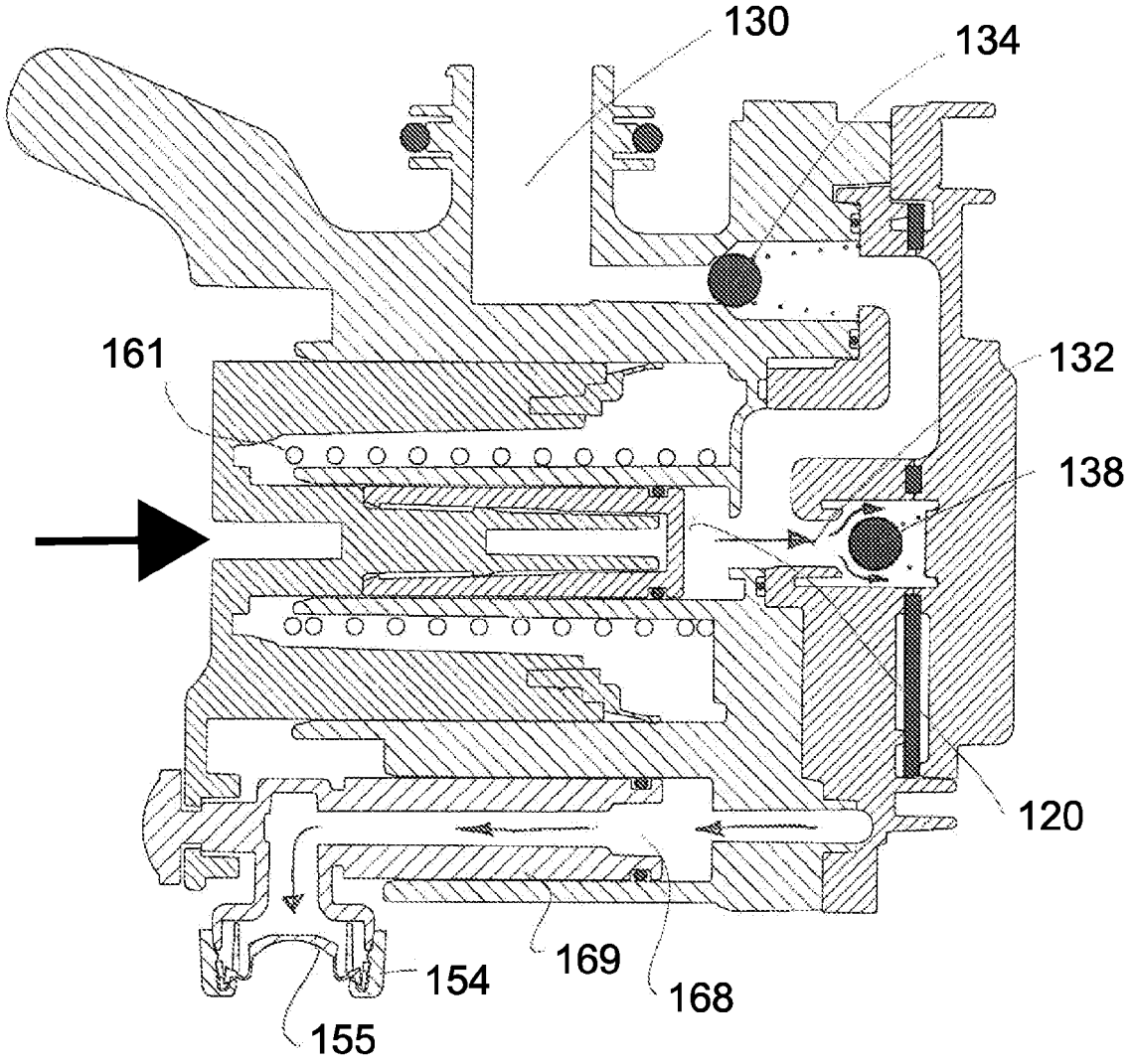
FIG. 16 is a cross sectional view of the improved pump along line A-A of FIG. 10 shown at an intermediate stage of the stroke which effects both the volume of the air chamber and the volume of the liquid chamber.

The liquid chamber 120 has a liquid inlet 130 and a liquid outlet 132 as best seen in FIGS. 14 to 16. The liquid chamber 120 is operably connected to the unpressurized liquid container 114 (shown in FIG. 7). A liquid inlet valve 134 is positioned between the liquid chamber 120 and the liquid container 114. The liquid chamber 120 is in flow communication with a foaming element 136. A liquid outlet valve 138 is positioned between the liquid chamber 120 and the foaming element 136. The inlet valve 134 and the outlet valve are each one way ball type valves. It will be appreciated that the ball type valve is by way of example only and that other types of valves could also be used.

The air chamber 124 has an air inlet 140 and an air outlet 142. An air inlet valve 144 is positioned between the air chamber 124 and the outside air. The air chamber 124 is in flow communication with the foaming element 136. In contrast to the embodiment described above with reference to FIGS. 1 to 6, pump 112 does not include an air outlet valve. When the pump stroke returns, the force required to open the air inlet valve 144 is less than the force required to draw foam in reverse through the sparging element 148 and thus an air outlet valve is not used in this embodiment. However, if desired pump 112 may include and air outlet valve. The foaming element 136 includes a sparging element 148 a foaming element air chamber 150 on one side thereof and a foaming chamber 152 on the other side thereof. The foaming element air chamber 150 is in flow communication with the air chamber 124 of the air pump portion 118. The foaming chamber 152 is in flow communication with the liquid chamber 120 of the liquid pump portion 116. Air is pushed under pressure through the sparging element 148 into the liquid in the foaming chamber 152 to create foam. The foam exits the foaming element 136 and travels through the foam outlet channel 166 into a merged flow channel 168. The merged flow channel 168 is defined by a shuttling exit nozzle piston 169 and is in flow communication with exit nozzle 154. Exit nozzle 154 is provided with an exit nozzle valve 155. The volume of the merged flow channel 168 is dependent on the position of the shuttling exit nozzle piston as can be seen in FIGS. 14 to 16. Thus foam is formed in the foaming element 136 travels through the foam outlet channels 166 into the merged flow channel 168 and exits the pump 112 through the exit nozzle 154.

Figure 17:
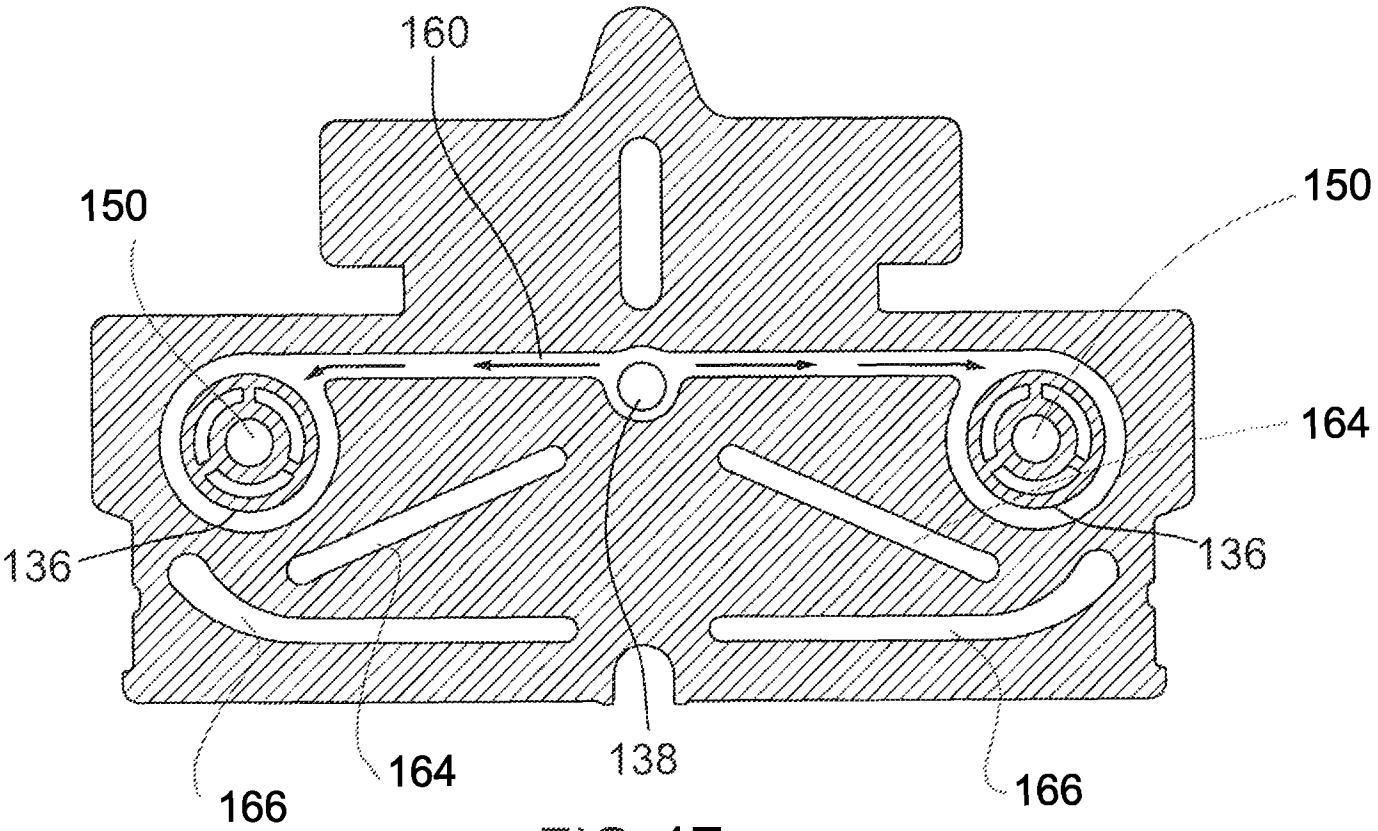
FIG. 17 is a cross sectional view of the liquid outlet chamber of the improved pump taken along line E-E of FIG. 11 and showing the liquid flow pathways.

FIGS. 8 to 19 show different stages and different portions of the pump as it moves through a stroke. FIG. 14 shows the liquid flow path 156 during the return stroke as liquid is drawn into the liquid chamber 116 through liquid inlet channel 158. A return spring 161 urges the air piston 126 and the shuttling liquid piston 122. As the stroke begins to move air is compressed in the air chamber 124 of air pump and the shuttling liquid piston 122 moves relative to the main portion 123 but the volume of the liquid chamber 120 does not change until the transition point shown in FIG. 15. The pump continues to move through the stroke and pushes liquid in the liquid chamber 120 through the liquid outlet 132 and past, the opened liquid outlet valve 138. The end of the stroke is shown in FIG. 16. The liquid flows from the liquid outlet 132 into liquid outlet channel 160 and to foaming chamber 152. In the embodiment herein there are a pair of liquid outlet channels 160 and a pair of foaming chambers 152, as best seen in FIG. 17. The volume of the two liquid outlet channels 160 and two foaming chambers 152 are the same. Thus the pair of foaming chambers 152 include a first foaming element and a second foaming element.

There are a number of advantages that are achieved by including a pair of foaming chambers 152. Specifically by providing a pair of foaming chambers 152 the effective dwell time of the air infusion process is increased. The use of the pair of foaming chambers 152 provides for double the volume of infusion over a shortened distance. The design shown herein with the pair of foaming chambers 152 provides a more balanced design than shown heretofore with a central activator or push point for the air piston 126 and liquid piston 122. Further the design shown herein provides for a more compact design than would be required if one large foaming chamber was used rather than the pair of foaming chambers 152 shown herein.

Figure 12:
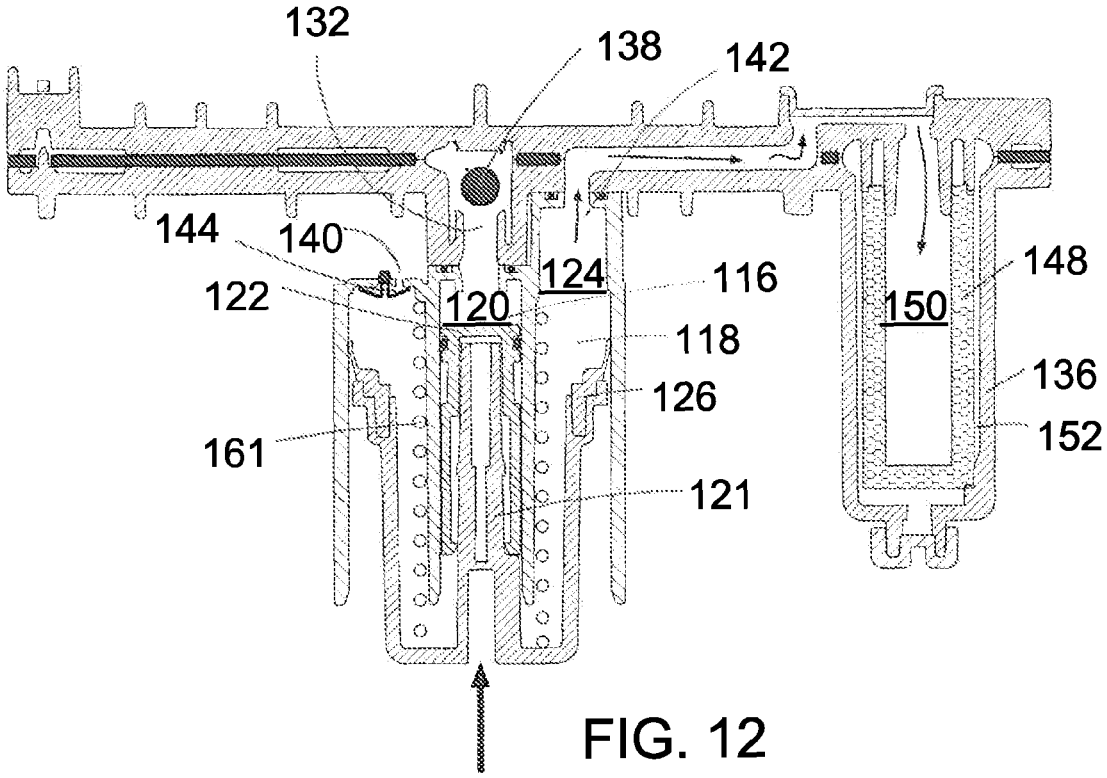
FIG. 12 is a sectional view of the improved pump of FIG. 10 taken along line B-B and showing the activation stroke.
Figure 13:
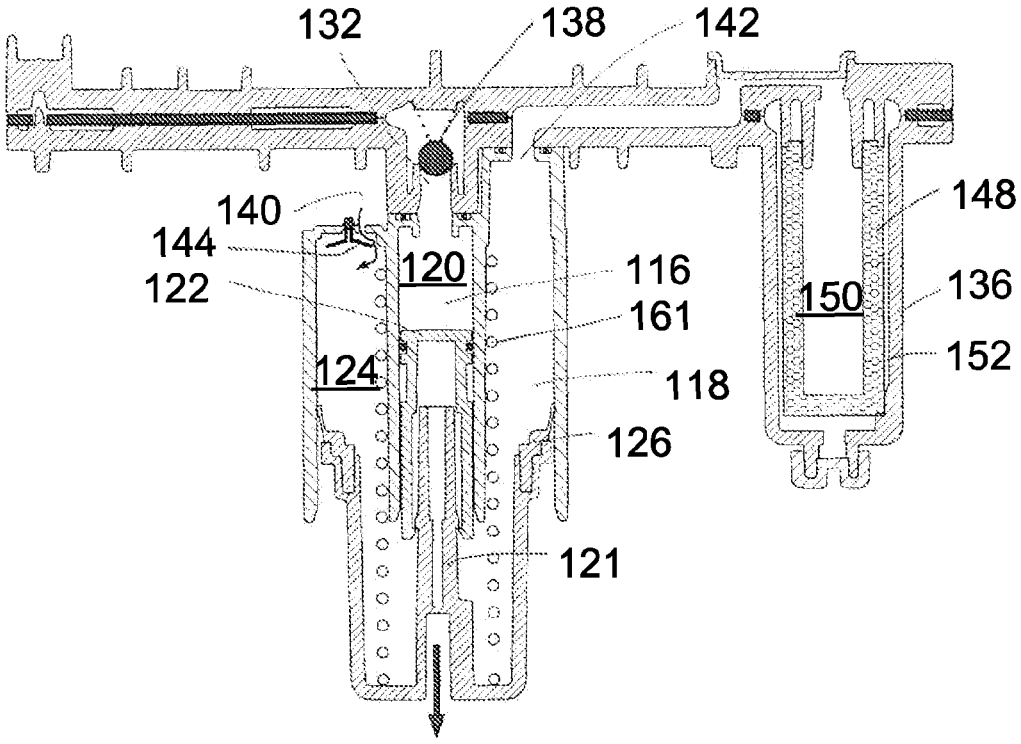
FIG. 13 is a sectional view of the improved pump that is similar to that shown in FIG. 12 but showing the return stroke.

The air inlet path is shown at 162 in FIGS. 12 and 13. In the return stroke, a vacuum is created in the air chamber, the one way air inlet valve 144 opens and air is drawn into the air chamber 124 as shown in FIG. 13. The air outlet path is shown at 164 in FIG. 12. At the beginning of the stroke the air piston 126 travels inwardly and reduces the volume of the air chamber 124 pushing air out of the air chamber 124 into an air outlet channel 164 and into the foaming element air chamber 150 shown in FIGS. 12, 13 and 19.

Figure 18:
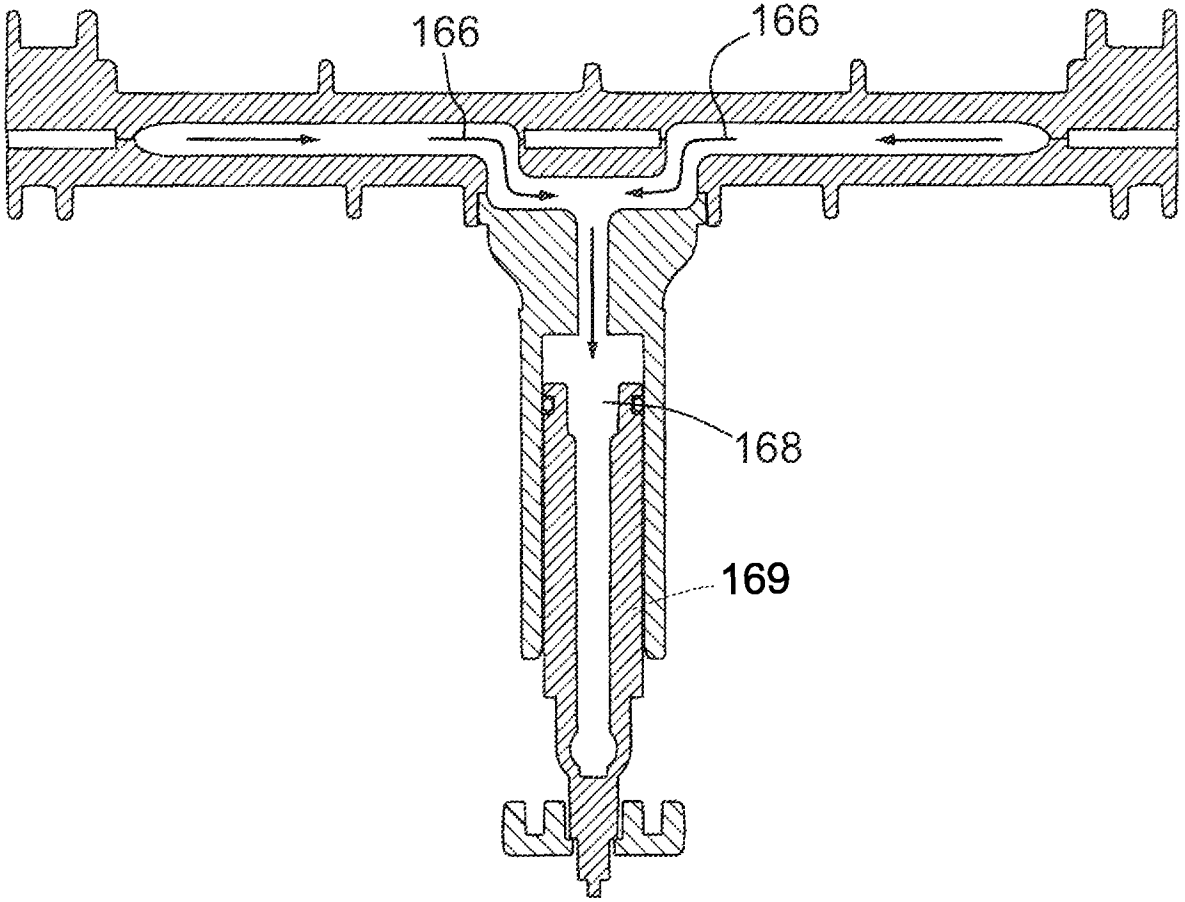
FIG. 18 is a cross sectional view of the exit nozzle of the improved pump taken along line D-D of FIG. 10 and showing the foam flow pathway.
Figure 19:
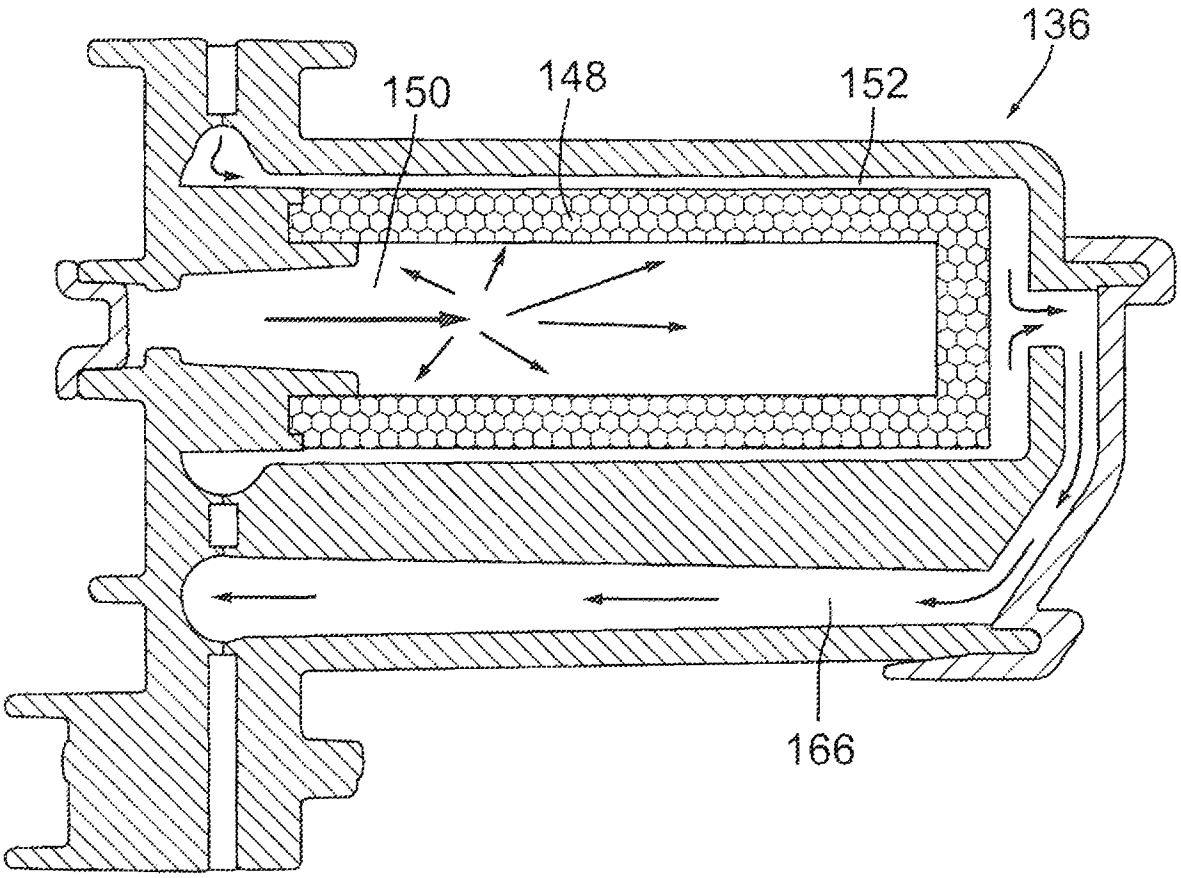
FIG. 19 is a cross sectional view one of the pair of foaming chambers of the improved pump taken along line C-C of FIG. 10 and showing the air flow path.

The foaming element shown in FIG. 19 shows the sparging element 148, the foaming element air chamber 150 and the foaming chamber 152. Foam from each foaming chamber 152 flows to the exit nozzle 154 through foam outlet channel 166 into a merged flow channel 168 as shown in FIG. 18.

Figure 20:
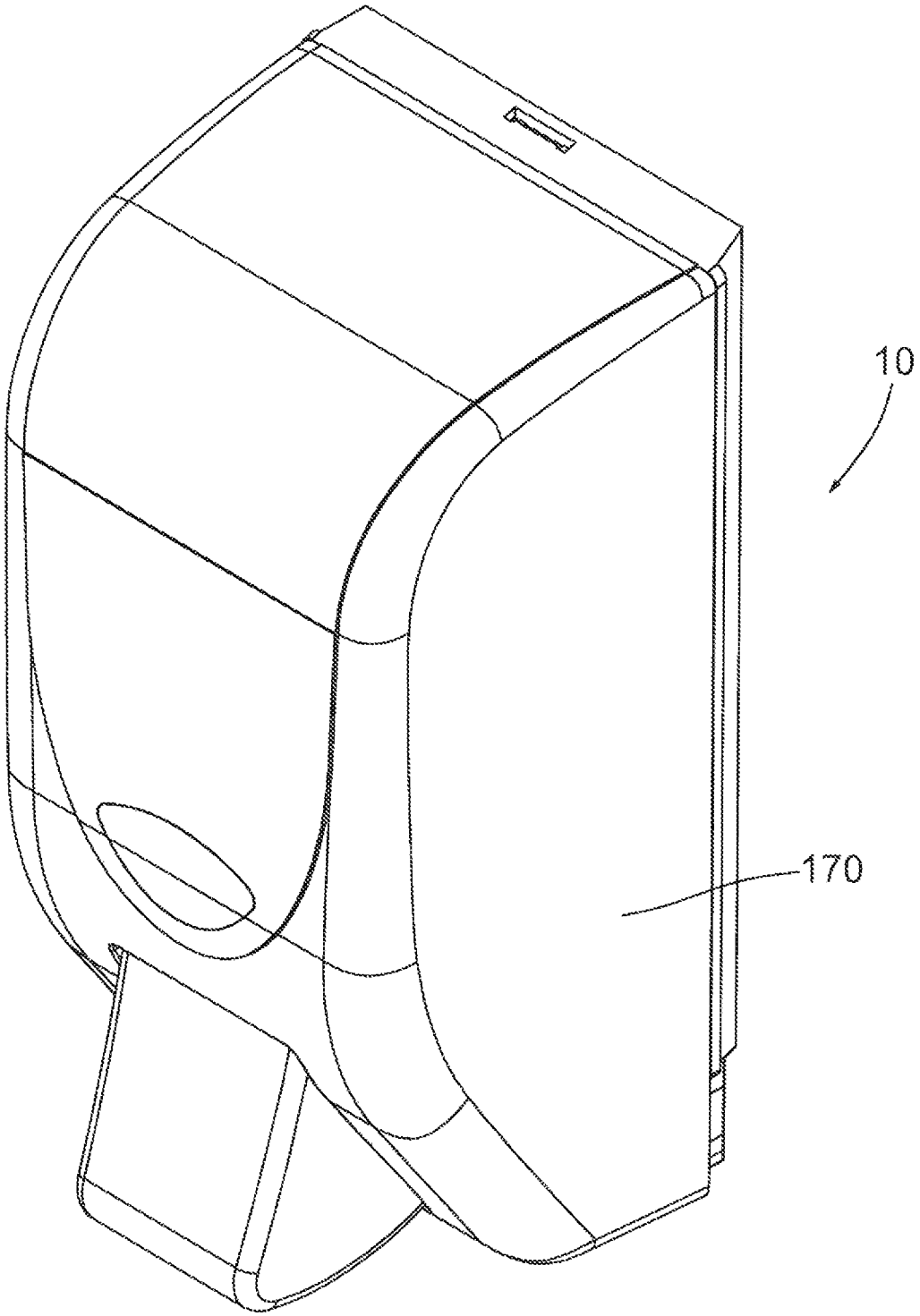
FIG. 20 is a perspective view of the dispenser which may include an improved pump.

The pump 112 may be housed in a dispenser 170 as shown in FIG. 20. The dispenser has a push button 172 which engages a combined shuttling liquid piston 122 and air piston 126.

Referring to FIGS. 21 to 25, an alternate pump is shown at 212. The pump 212 includes a liquid piston pump portion 216 and an air pump portion 218. The liquid piston pump portion 216 includes a liquid chamber 220 and a liquid piston 222. The liquid piston 222 is a shuttling liquid piston. The air pump portion 218 includes an air chamber 224 and an air piston 226. The shuttling liquid piston 222 and the air piston 226 are both operably connected to an activator (not shown). The shuttling liquid piston 222 includes a shuttle portion 221 and a main portion 223. The air piston 226 is attached to the shuttle portion 221 of the shuttling liquid piston 222.

The liquid chamber 220 has a liquid inlet 230 and a liquid outlet 232. The liquid chamber 220 is operably connected to the unpressurized liquid container (not shown). A liquid inlet valve 234 is positioned between the liquid chamber 220 and the liquid container. The liquid chamber 220 is in flow communication with a mixing chamber 236. A liquid outlet valve 238 is positioned between the liquid chamber 220 and the mixing chamber 236.

The air chamber 224 has an air inlet 240 and an air outlet 242. The air chamber 224 is in flow communication with a mixing chamber 236. In the mixing chamber 236 air from the air chamber 224 and liquid from the liquid chamber 220 are mixed together. The mixed air and liquid is then pushed through a foaming portion 248 and into the exit nozzle. The foaming portion 248 may be a gauze mesh, gauze, foam, sponge or other suitable porous material. The mixed air and liquid is pushed through the foaming portion 248 to create foam. The foaming element in this embodiment includes the mixing chamber 236 and a foaming portion 248.

Figure 22:
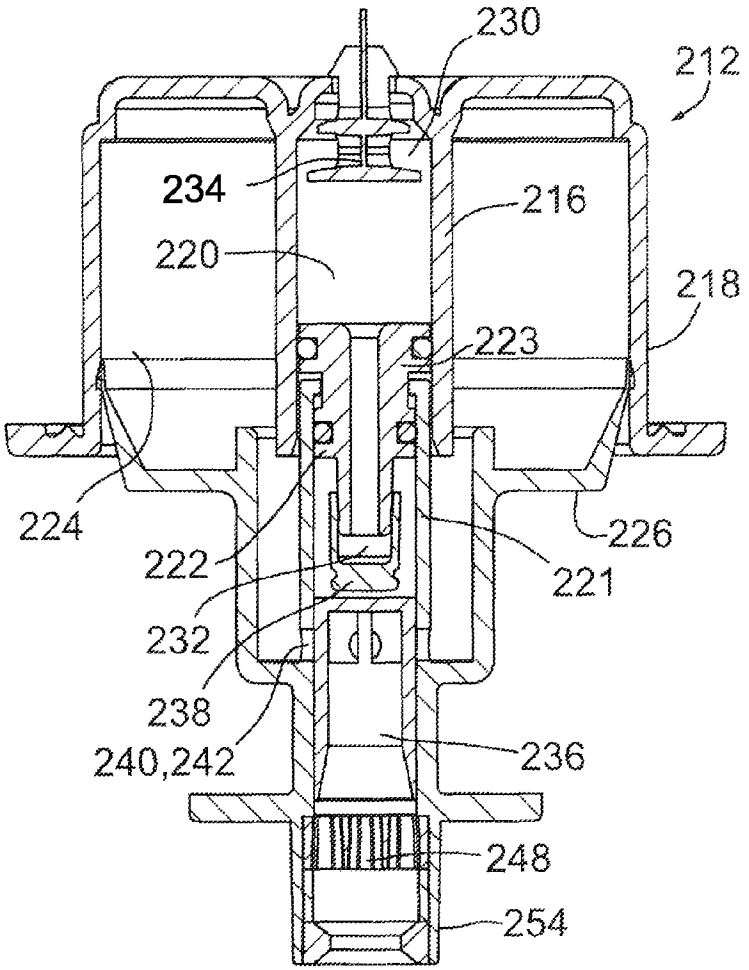
FIG. 22 is a cross sectional view of the improved pump of FIG. 21 shown partially through the first stage of the stroke.
Figure 21:
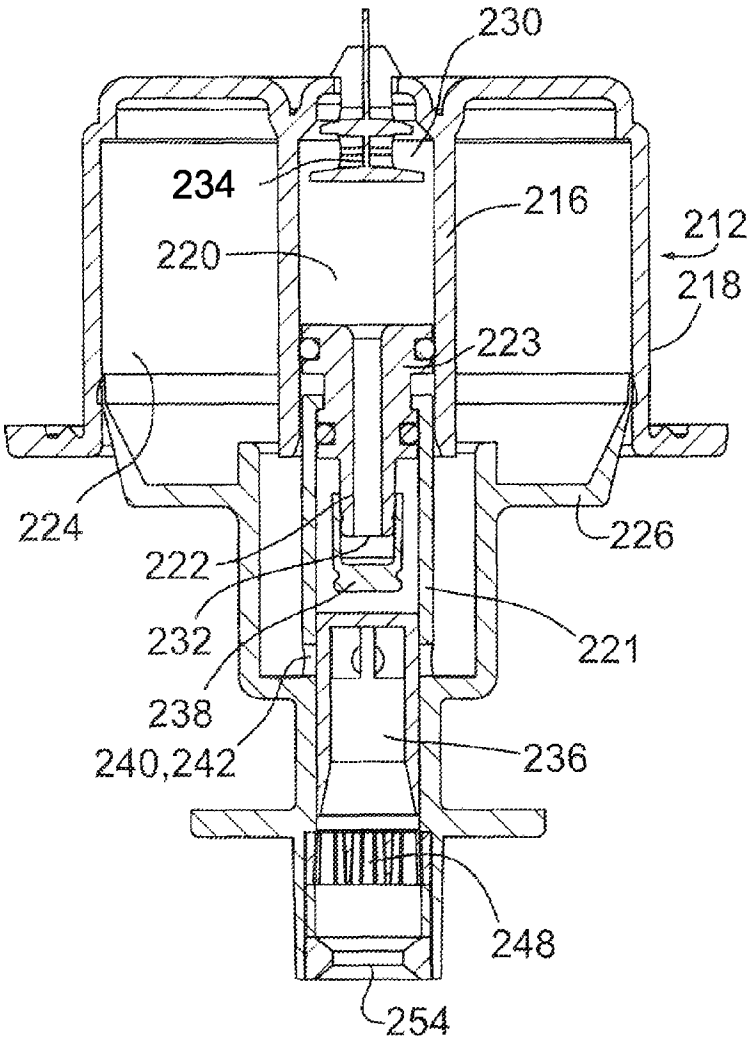
FIG. 21 is a cross sectional view of an alternate embodiment of an improved pump shown at the beginning of the stroke.
Figure 24:
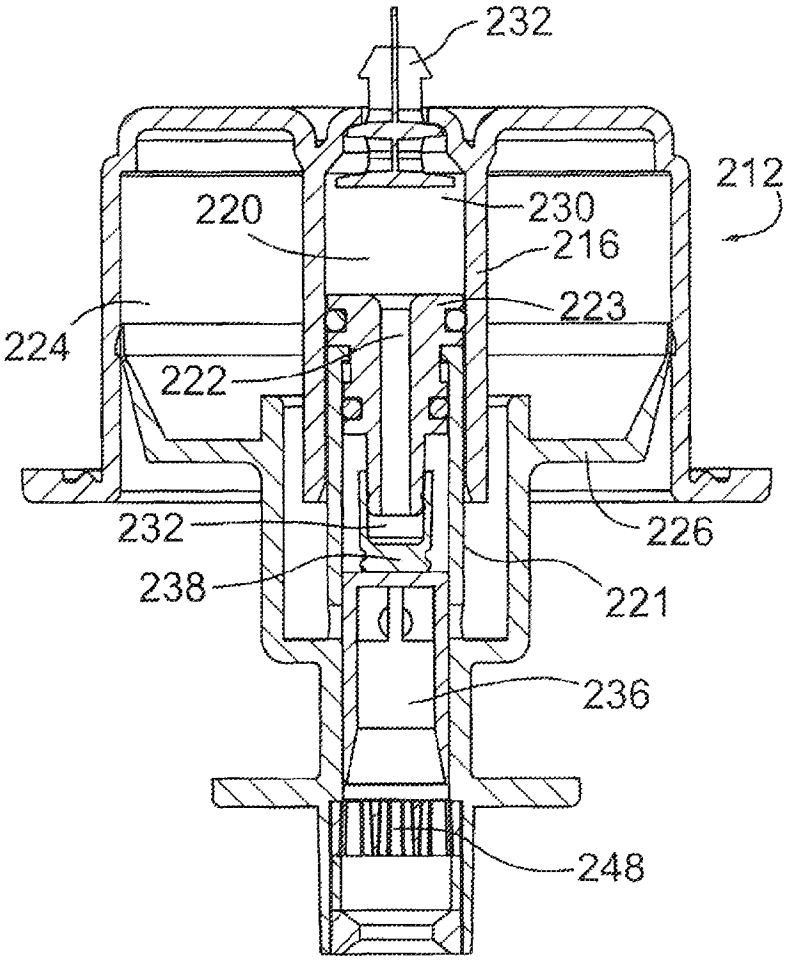
FIG. 24 is a cross sectional view of the improved pump of FIGS. 21 to 23 shown partially through the intermediate stage of the stroke.
Figure 23:
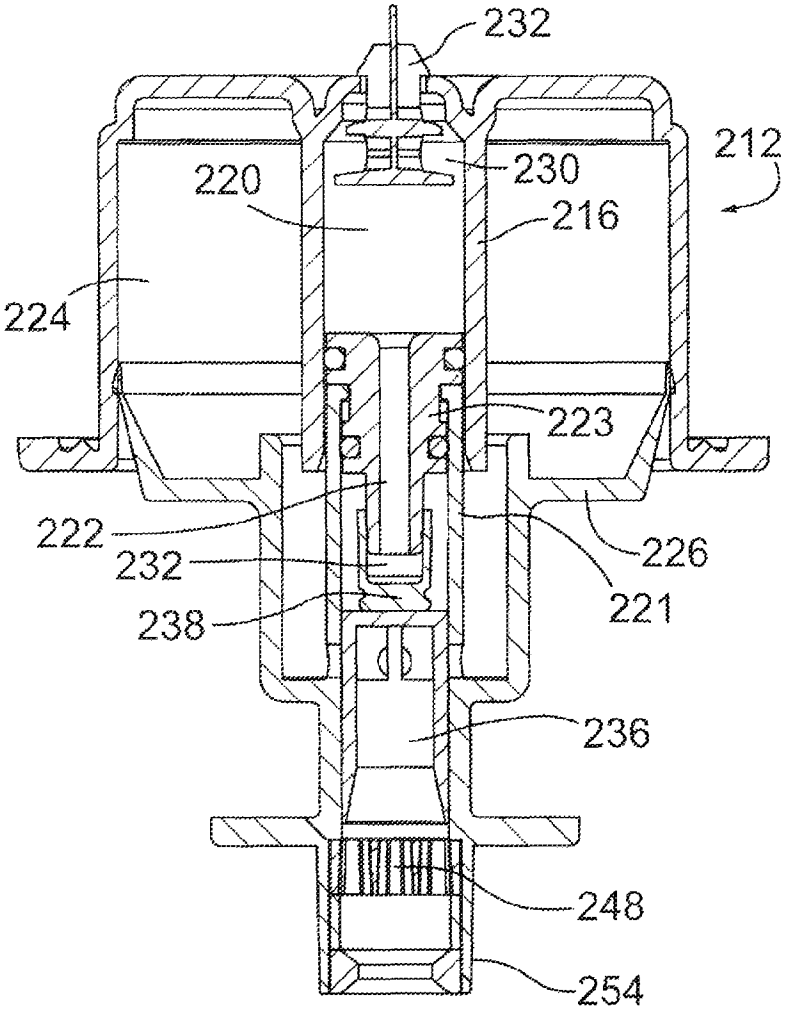
FIG. 23 is a cross sectional view of the improved pump of FIGS. 21 and 22 shown at the transition point between end of the first stage and an intermediate stage of the stroke.
Figure 25:
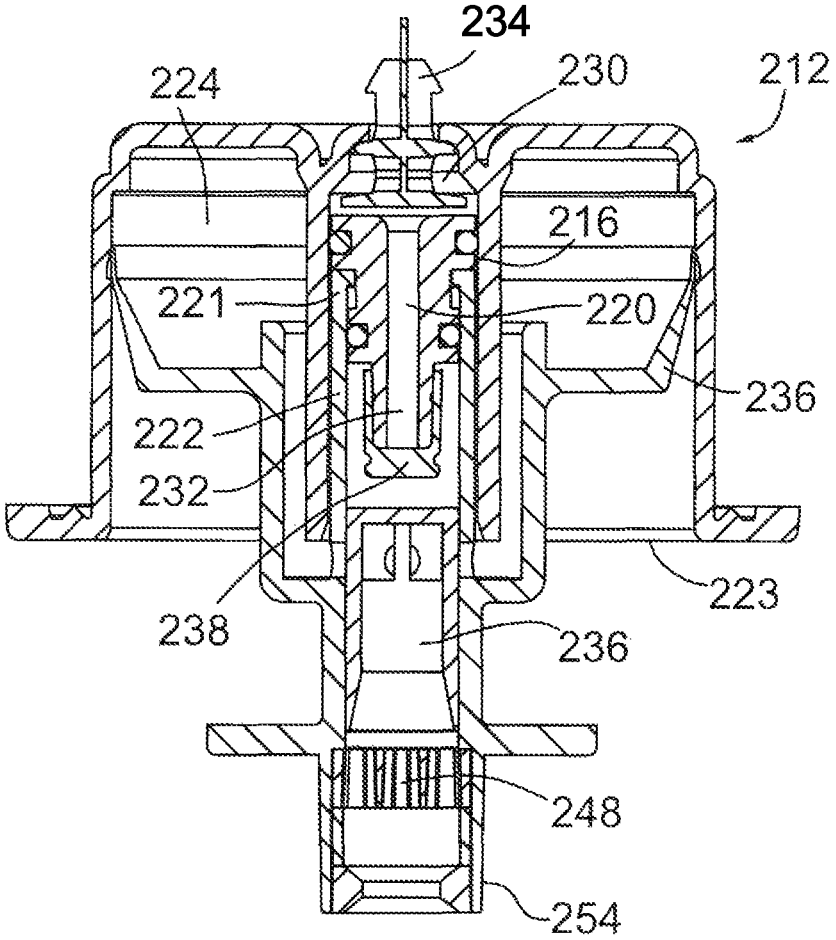
FIG. 25 is a cross sectional view of the improved pump of FIGS. 21 to 24 shown at end of the stroke.

FIGS. 21 to 25 show the stages of the pump as it moves through a stroke. FIG. 21 shows the pump 212 at rest. As the stroke begins to move, as shown in FIG. 22, air is compressed in the air chamber 224 of air pump and air under pressure enters the mixing chamber 236. As the air pressure builds air and liquid is pushed through the foaming element 248. In the initial stages of the stroke the shuttle portion 221 moves relative to the main portion 223 of the liquid piston 222 and volume of the liquid chamber 220 does not change as shown in FIGS. 22 and 23. This is the "priming" stage where the air chamber is "primed" before the liquid pump is engaged. Once the shuttle portion 221 engages the main portion 223 of the liquid piston 222 the liquid piston 222 moves together with the air piston 226 and pressure builds in the liquid chamber 220 and the liquid outlet valve 238 opens and liquid flows into the mixing chamber 236 as shown in FIG. 24. At the end of the stroke, shown in FIG. 25, the direction of the movement of air piston 226 and shuttling liquid piston 22 changes. This is typically when the user stops pushing an activator or pushbutton inwardly (not shown). At the end of the stroke, the liquid inlet valve 234 is closed; the liquid outlet valve 238 is closed; and the air inlet valve 244 is closed.

It is clear from the prior art that a solution is needed to overcome the fundamental issue that air is compressible and liquids are not in order to maximize the efficiency of infusing the liquid with air in the pump to create a high quality foam.

The pumps described herein first build sufficient pressure on the air side of the pump so that when the liquid begins to be pumped it can be immediately infused with air thus maximizing the infusion process in order to optimize the quality of the foam being dispensed from the pump.

The foam pump described herein generate internal air pressure prior to the simultaneous pumping of the air and liquid. In simple terms, the dispensing action begins by pumping air for a portion of the dispensing stroke followed by the pumping of air and liquid together. The pressurising of the air side allows for the more efficient infusion of the liquid creating a higher quality of foam for the user.

Generally speaking, the systems described herein are directed to foaming pump. Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the terms "operably connected" means that the two elements may be directly or indirectly connected.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

What is claimed is:

1. A non-aerosol foam pump for use in association with an unpressurized liquid container and a foaming element comprising:

a liquid pump portion having a liquid chamber with a liquid internal volume and a shuttle liquid piston including a shuttle portion and a main portion and the shuttle portion slidingly engages the main portion, the liquid chamber being in flow communication with the unpressurized liquid container and in flow communication with the foaming element;

an air pump portion having an air chamber with an air internal volume, the air chamber in flow communication with the foaming element; and wherein the non-aerosol foam pump has an activation stroke activating the liquid pump portion and the air pump portion and a return stroke and during the activation stroke the air internal volume is reduced and during a beginning stage of the activation stroke the shuttle portion slides relative to the main portion such that the liquid internal volume of the liquid chamber remains the same and during a later stage of the activation stroke the shuttle portion engages the main portion so that the liquid internal volume of the liquid chamber is reduced.

2. The non-aerosol foam pump of claim 1 wherein foaming element includes a sparging element, a foaming element air chamber in flow communication with the air chamber and a foaming chamber in flow communication with the liquid chamber and wherein air is pushed from the foaming element air chamber through the sparging element into the foaming chamber.

3. The non-aerosol foam pump of claim 2 wherein the foaming element is a first foaming element and further including a second foaming element and wherein liquid from the liquid chamber is in flow communication with the first and second foaming element and air from the air chamber is in flow communication with the first and second foaming element and wherein the first and second foaming element each have exit channels that merge into a merged flow channel and into an exit nozzle.

4. The non-aerosol foam pump of claim 1 further including a dispenser for housing the liquid pump portion, the air pump portion and liquid container.

5. The non-aerosol foam pump of claim 1, wherein the air pump portion further comprises an air piston.

6. The non-aerosol foam pump of claim 5, further including an activator connected to the air piston and the shuttle portion of the shuttle liquid piston, whereby the air piston is operably connected to the shuttle liquid piston through the activator.

7. The non-aerosol foam pump of claim 6, wherein the shuttle portion of the shuttle liquid piston is slidingly attached to the activator and the air piston is rigidly attached to the activator.

8. The non-aerosol foam pump of claim 5, the air piston is operably connected to the liquid piston, such that the shuttling liquid piston is actuated upon actuating the air piston.

9. The non-aerosol foam pump of claim 8, wherein liquid chamber is co-axial with the air chamber.

10. The non-aerosol foam pump of claim 9 wherein the air piston includes a liquid piston portion that slidingly engages the shuttle liquid piston.

11. The non-aerosol foam pump of claim 9 further including a liquid outlet valve between the liquid chamber and the foaming element.

12. The non-aerosol foam pump of claim 8, wherein the shuttle liquid piston extends coaxially within the air pump portion, and the air piston is attached to the shuttle portion of the shuttle liquid piston.

13. The non-aerosol foam pump of claim 12, further including a liquid outlet valve between the liquid chamber and the foaming element.

14. The non-aerosol foam pump of claim 13 wherein the foaming element comprises a mixing chamber and a foaming portion, whereby a mixture of the air and liquid is pushed from the mixing chamber through the foaming portion.

15. The non-aerosol foam pump of claim 1 wherein the foaming element includes a foaming portion and the foaming portion is a porous member.

16. The non-aerosol foam pump of claim 1 including:

a first foaming element and a second foaming element and wherein liquid from the liquid chamber is in flow communication with the first and second foaming element and air from the air chamber is in flow communication with the first and second foaming element and wherein the first foaming element and second foaming element each have exit channels that merge into a merged flow channel and into an exit nozzle.

17. The non-aerosol foam pump of claim 16 wherein the first foaming element and the second foaming element each include a sparging element, a foaming element air chamber in flow communication with the air chamber and a foaming chamber in flow communication with the liquid chamber and wherein air is pushed from the foaming element air chamber through the sparging element into the foaming chamber.

* * * * *